US006457320B1

(12) United States Patent
Nishikawa et al.

(10) Patent No.: US 6,457,320 B1
(45) Date of Patent: Oct. 1, 2002

(54) AIR CONDITIONER, ITS INSTALLATION TOOL, AND METHOD OF INSTALLATION OF AIR CONDITIONER

(75) Inventors: Kazuhiro Nishikawa, Osaka; Hirozumi Ito, Shiga; Hiroharu Kurisutani, Shiga; Yasuhiro Nakamura, Shiga; Kenji Shirai, Shiga, all of (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 0 days.

(21) Appl. No.: 09/342,769

(22) Filed: Jun. 29, 1999

(30) Foreign Application Priority Data

Jun. 29, 1998 (JP) ..... 10-181859
Jun. 29, 1998 (JP) ..... 10-181860

(51) Int. Cl.[7] ..... F25D 23/12

(52) U.S. Cl. ..... 62/259.1; 62/298; 62/285; 62/297; 62/263

(58) Field of Search ..... 62/298, 285, 297, 62/259.1, 263

(56) References Cited

U.S. PATENT DOCUMENTS 2,275,295 A * 3/1942 Greenway ..... 62/140
2,633,718 A * 4/1953 Wile ..... 62/140
2,773,364 A * 12/1956 Zipser ..... 62/140
3,302,426 A * 2/1967 Laing ..... 62/263
4,664,179 A * 5/1987 Yokoyama ..... 165/76
4,854,375 A * 8/1989 Frina et al. ..... 165/53
5,191,770 A * 3/1993 Kim ..... 62/263
5,361,981 A * 11/1994 Albert et al. ..... 236/42
5,388,426 A * 2/1995 Wada et al. ..... 62/263
5,697,226 A * 12/1997 Marchesi ..... 62/263
5,775,408 A * 7/1998 Shimek et al. ..... 165/48.1

FOREIGN PATENT DOCUMENTS

JP 09166353 6/1997
JP 09170810 6/1997

* cited by examiner

*Primary Examiner*—William Doerrler
*Assistant Examiner*—Mark Shulman

(57) ABSTRACT

An air conditioner which can be installed easily at a corner of a room is presented. This is an air conditioner which can be installed at a corner between a first wall and a second wall of a room. It has a frame body having an upper part, a lower part, and side parts, a blower for circulating air, a heat exchanger for exchanging heat with the air, an air diffuser for blowing out the air into the room, a space positioned at an edge of the corner, and a piping connected to the heat exchanger. The connection port of the piping is placed at least at one of (a) a position projecting into the space and (b) a place near the space. This is an installation tool for installing an air conditioner main body having a first side surface and a second side surface at a corner of a first wall and a second wall of a room. The tool includes a first installation board having a first base part and a first stopping part, and a second installation board having a second base part and a second stopping part. The fist installation board is fixed on the first wall, the second installation board is fixed on the second wall, the first installation board holds the first side, and the second installation board holds the second side.

21 Claims, 22 Drawing Sheets

AIR CONDITIONER, ITS INSTALLATION TOOL, AND METHOD OF INSTALLATION OF AIR CONDITIONER

FIELD OF THE INVENTION

The present invention relates to an air conditioner for cooling or heating, and more particularly to an air conditioner installed at a corner on the walls of a room.

BACKGROUND OF THE INVENTION

A conventional air conditioner to be installed at a corner of a room is constituted as shown in FIG. 29 through FIG. 33 as disclosed in Japanese Laid-open Patent No. 9-166353. FIG. 29 is a perspective view of an installed state of an air conditioner. FIG. 30 is a bottom view of FIG. 29. FIG. 31 is a sectional view along line 31—31 in FIG. 30. FIG. 32 is an essential sectional view in a bottom view of FIG. 29. FIG. 33 is a perspective view in an open state of suction grille of FIG. 29.

An air conditioner main body 71 is installed closely to a corner of the ceiling and two walls of a living room. A suction grille 75 which is an air suction port is installed at the lower side of the main body 71, and has a sector shape of a quarter of an arc. A heat exchanger 77 is disposed in the upper direction of a water pan 76. While a cross flow fan 73 is being rotated by a drive unit 74, the air is sucked into the air suction grille 75, and the heat is exchanged through the heat exchanger 77, and air flows into an air diffuser 72. In this way, the air conditioner blows air.

The air conditioner main body 71 has a wind direction change device 81, and an internal connection piping 78. Thus, since the main body 71 is installed at a corner of a room, it matches very well with the interior without causing any feel of oppression. Moreover, since a connection piping 79 is laid out as shown in FIG. 31, the piping work may be accessed from either one of the two walls at the time of installation work, and the installation work is easy by making an opening 75*a* in the suction grille 75 as shown in FIG. 32.

In such conventional constitution, however, the connection piping 79 from the outdoor unit must be passed through a hole 80 provided in the main body 71. When the connection piping 79 is buried in the wall and then the main body 71 is installed on the wall, the main body 71 must be installed on the wall while passing the connection piping 79 through the hole 80. The drain hose and the connection wiring, which are not shown in the drawings, must be also passed similarly. Besides, after installing the main body 71, when connecting the internal connection piping 78 and connection piping 79 to the main body 71, since they are surrounded by the main body 71, the working space is narrow and limited. Therefore, the connection work was difficult.

A conventional installation tool of an air conditioner is constituted as shown in FIG. 28, in which an air conditioner main body 501 having a hook-shaped engaging part 503 is supported by a flat installation board 502 having a stopping piece 504. The installation board 502 is fixed to the wall by screws, and the air conditioner is installed by inserting the engaging part 503 of the air conditioner main body 501 into its stopping piece 504.

The conventional air conditioner is supported on one wall only. Therefore, when the air conditioner main body projecting largely from the wall is installed on the wall, if the main body is installed by using one installation tool, the main body becomes unstable in installed state.

SUMMARY OF THE INVENTION

The air conditioner of the invention is an air conditioner which can be installed at a corner of a first wall and a second wall of a room, which comprises a frame body having an upper part, a lower part, and side parts, a blower for circulating air, a heat exchanger for exchanging heat with the air, an electrical unit, an air diffuser for blowing out the air into the room, a space positioned at an edge of the corner, and a piping connected to the air conditioner, in which a piping port of the piping is disposed at least one of (a) a position extending into the space, and (b) a position near the space.

Preferably, one of (a) the upper part and (b) an upward part of the upper part and the side part extends into the space.

In this constitution, when installing the main body in the room, the working space for connecting the connection piping and others from the outdoor unit is kept. As a result, it is easier to install the air conditioner.

The installation tool of the invention is used for the purpose of mounting the air conditioner main body at a corner of a room, and comprises a first installation board having a first stopping part, and a second installation board having a second stopping part. A first installation tool is installed on a first wall forming a corner of a room, and a second installation tool is installed on a second wall. The air conditioner main body includes a first side surface having a first engaging part, and a second side surface having a second engaging part. The first engaging part is engaged in the first stopping part and the second engaging part is engaged in the second stopping part.

The method of installation of air conditioner of the invention comprises, in the case of installation of the air conditioner at a corner of a room, a step of mounting a first installation board having a first stopping part to be engaged with a first engaging part installed at a first side surface of the air conditioner to a first wall, a step of mounting a second installation board having a second stopping part to be engaged with a second engaging part installed at a second side surface of the air conditioner to a second wall, and a step of engaging the first engaging part in the first stopping part, engaging the second engaging part in the second stopping part, and mounting the main body on the first installation board and second installation board.

According to this constitution, when installing the air conditioner at a corner of a room, the mounting work is extremely easy, and the mounting operation is enhanced. Moreover, the safety in the installed state is enhanced.

BRIEF DESCRIPTION OF THE DRAWINGS

FIG. 21(*b*) is a plan view of FIG. 21(*a*) as seen from the arrow direction.

FIG. 22(*b*) is a plan view of FIG. 22(*a*) as seen from the arrow direction.

FIG. 22(*c*) is an essential magnified view of FIG. 22(*a*).

FIG. 23(*b*) is a plan view of FIG. 23(*a*) as seen from the arrow direction.

FIG. 23(*c*) is an essential magnified view of FIG. 23(*a*).

FIG. 24(*b*) is a plan view of FIG. 24(*a*) as seen from the arrow direction.

FIG. 24(*c*) is a detailed view of the installation board.

FIG. 26(*b*) is a plan view of FIG. 26(*a*) as seen from the arrow direction.

FIG. 27(*b*) is a plan view of FIG. 27(*a*) as seen from the arrow direction.

FIG. 27(*c*) is a sectional view along line 27(c)—27(c) of FIG. 27(*b*).

REFERENCE NUMERALS

Figure 1:
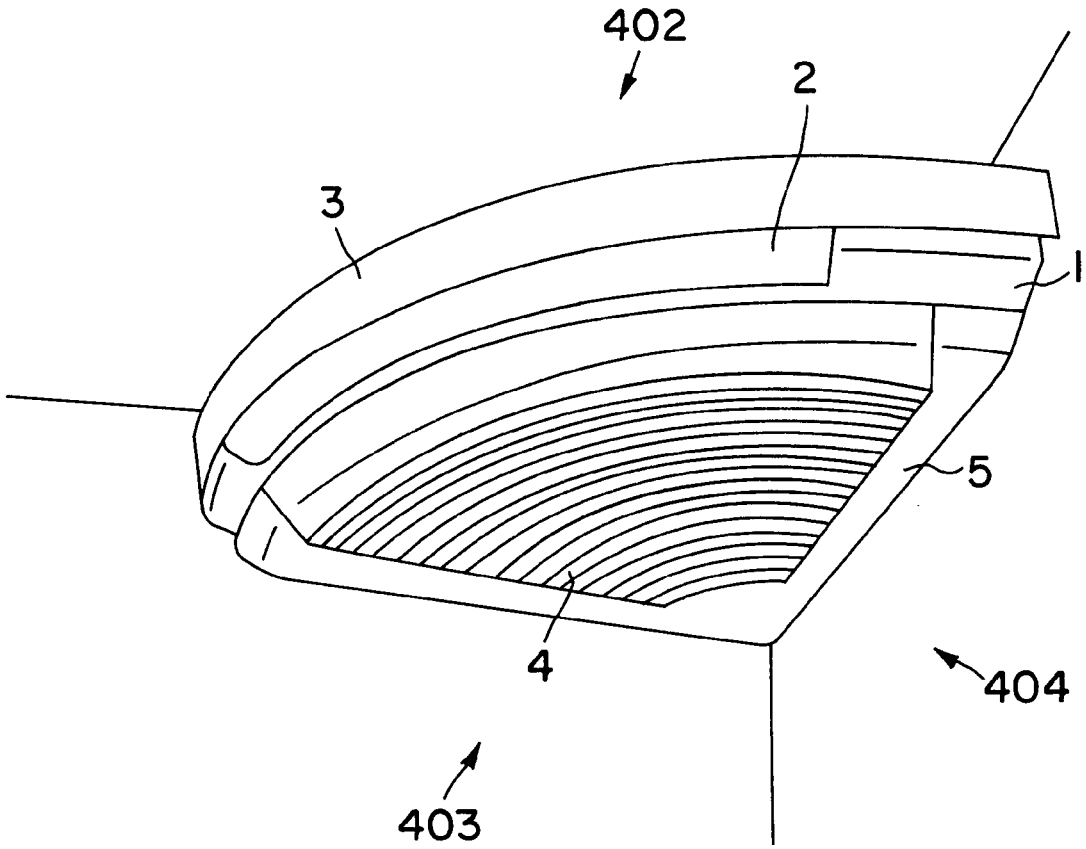
FIG. 1 is a perspective view of an air conditioner showing a first exemplary embodiment of the invention.

1 Mainbody
1*a, b, c, d* Sixth engaging hole
1*e, f, g, h* Screw hole
1*i* First hooking flange
1*j* Second hooking flange
1*k* First slit
1*r* Stopping means (provisional holding part)
1*s* First handle
1*v* Second handle
1*w* Third handle
1*x* Corner
2 Air diffuser
3 Wind direction changing device
4 Suction grille
4*a* Third bump
4*b, c, d, e* Fourth bump
5 Suction grille frame
5*a*First engaging hole
5*b* Second engaging hole
5*c* Third engaging hole
5*d, e, f, g* Fourth hole
6 First connection piping
7 First connection port for linking drain hose
8 Second connection port for linking drain hose
9 Electrical unit box
10 First installation board
10*a* First support
10*b* First bump
11 Second installation board
11*a* Second support
11*b* Second bump
12 Upper cover
13 Second connection piping linking to outdoor unit
14 Drain hose
15 Connection wiring
16 Cap
17 Screw
402 Ceiling
403 First wall
404 Second wall
201 Air conditioner main body
205 Second wall
206 First wall
207 Ceiling
209 Second installation board
212 First installation board
214 Engaging part
215 Fixing part
216 Stopping part
219 Horizontal setting part

220, 21 Mounting position setting part

223 Rotary part

225 Main body installation board

226 Ceiling installation board

229 Ceiling stopping part

230 Ceiling engaging part

255 Base part

DETAILED DESCRIPTION OF THE INVENTION

The air conditioner of the invention comprises a main body having an air diffuser, a blower, a heat exchanger, an electrical unit and others, and a suction grill unit installed at the lower side of the main body. The air conditioner is installed at a corner of two walls in a living room. An air suction port is disposed at the lower side of the main body, and an air diffuser is disposed at the horizontal front side. The main body is shape as if a nearly triangular portion is cut off from an edge of the corner. The connection port of the piping communicating with the heat exchanger is projecting into the space of thus cut-off triangular portion or positioned near this space. In this constitution, since the corner of the main body is cut off, a working space for installation of the main body is kept. Therefore, the connection piping and others from the outdoor unit can be installed easily.

Preferably, the main body has a shape formed by cutting off the corner except for the upper part or the upward part of the upper part and side part. The connection port of the piping from the heat exchanger projects into this cut-off space. Or the connection port is position near the space. In this constitution, the above effect is further enhanced.

Preferably, a specified slit is placed in the upper part of the corner side of the main body, and the corner can be cut off at this slit. In this constitution, the upper part of the corner side of the main body can be cut off easily. Accordingly, the connection piping from the outdoor unit can be drawn into the main body, also from the ceiling side. As a result, the degree of freedom of installation method of the air conditioner is enhanced, and the installation work is much easier.

Preferably, the connection port to the drain hose for discharging the condensate of the heat exchanger is placed near the space and near the wall. In this constitution, the connection work of the drain hose can be done by utilizing the space after installing the main body, so that the installation work of the air conditioner is extremely easy.

Preferably, the electrical unit is provided in the main body near the space, and the electrical unit is provisionally held at the lower side of the main body. Thus, the electrical unit is temporarily separated from the space. In this constitution, in the case of piping connection work, the electrical unit located near the working space is temporarily held at the lower side of the main body. Therefore, the working space is further expanded, and the installation work of the air conditioner is much easier.

Preferably, the cover is placed separately from the main body, at a position covering the upper side of the space. In this constitution, invasion of dust from upper direction is prevented. Further, as the package size for transportation, as compared with the main body composed together with the cover integrally, the size can be reduced, and the transportation cost is reduced, and it is easier to carry.

Preferably, the cover has a slit of a specified shape. In this constitution, the cover placed on the upper part of the corner side can be cut off. Hence, the connection piping from the outdoor unit can be drawn into the main body also from the ceiling side. As a result, the degree of freedom of installation method is enhanced, and the installation work is much easier.

Preferably, the cover is made of a material that can be cut off easily. In this constitution, the cover placed on the upper part of the corner side can be cut off. Hence, the connection piping from the outdoor unit can be drawn into the main body also from the ceiling side, and the degree of freedom of installation method is enhanced, and hence the installation work is much easier.

Preferably, the air conditioner is constituted so that the suction grille can be mounted after mounting the main body at a corner of two walls. In this constitution, the piping can be connected while the suction grille is not installed yet. As a result, the working space is wider and the ease of work is further enhanced.

Preferably, the suction grille is held in the main body and is also held on the installation member for mounting the main body. In this constitution, the corner side not holding the suction grille due to the main body can be held by the installation member. As a result, the holding strength of the suction grille is enhanced.

Preferably, only the vertical direction of the suction grille is held by the installation member, and the main body holds the vertical direction of the suction grille, so that the position in the horizontal direction is determined. In this constitution, if the position is deviated between the main body and the installation member, the suction grille is positioned by the main body that requires positioning. Further, the vertical direction which requires the holding strength is held by the installation member. As a result, the strength for holding the air conditioner is further enhanced.

Preferably, the handle is placed at the contacting side or near the space being cut off at the corner side of the main body. In this constitution, when the worker installs the main body, this handle and the front air diffuser can be held, so that it can be carried securely, and the working efficiency is notably enhanced.

Preferably, the handle is placed at the lower side of the main body. In this constitution, when installing the main body, the worker can hold this handle, and it can be carried securely and the installation work is enhanced.

The method of installation of air conditioner of the invention comprises, in the case of installation of the air conditioner at a corner of a room, a step of mounting a first installation board having a first stopping part to be engaged with a first engaging part installed at a first side surface of the air conditioner to a first wall, a step of mounting a second installation board having a second stopping part to be engaged with a second engaging part installed at a second side surface of the air conditioner to a second wall, and a step of engaging the first engaging part in the first stopping part, engaging the second engaging part in, the second stopping part, and mounting the main body on the first installation board and second installation board.

The installation tool of air conditioner of the invention is used for the purpose of mounting the air conditioner main body at a corner of a room, and comprises a first installation board having a first stopping part, and a second installation board having a second stopping part. A first installation tool is installed on a first wall forming a corner of a room, and a second installation tool is installed on a second wall. The air conditioner main body includes a first side surface having a first engaging part, and a second side surface having a second engaging part. The first engaging part is engaged in the first stopping part and the second engaging part is engaged in the second stopping part.

In this constitution, the air conditioner main body can be installed on two walls, so that the installation work of the air conditioner main body is easier. Further, the strength of installation of the air conditioner is notably enhanced.

Preferably, the first installation board has a first horizontal part placed at the upper end, and the second installation board has a second horizontal part placed at the upper end, and as these horizontal setting parts are joined at the ceiling, the air conditioner main body is installed horizontally. In this constitution, when mounting the first installation board and the second installation board on the wall, it does not require level, angle gauge or other tool, and these installation tools can be mounted horizontally on the ceiling, so that the main body can be easily mounted horizontally.

Preferably, the first installation board has a first mounting position setting part at its end, and the second installation board has a second mounting position setting part at its end. Fixing the first mounting board setting part on the second wall and fixing the second mounting board setting part on the first wall, the mounting position of the first installation board and second installation board is determined. In this constitution, the first installation board and the second installation board can be mounted symmetrically to the intersecting line of the first wall and second wall. Further, by freely designing the shape of these mounting position setting parts, if there is a protrusion at the corner edge of the first wall and second wall, the air conditioner main body can be easily installed at the corner by avoiding the protrusion.

Preferably, the first installation board extends to the air conditioner main body side, and has a first rotary part having a first hole at the leading end side, and the second installation board extends to the air conditioner main body side, and has a second rotary part having a second hole at the leading end side. The first hole and second hole are screwed together so that the first installation board and second installation board may rotate together. In this constitution, the mounting position of the first installation board and second installation board can be determined. Further, these installation boards can be installed along the first wall and second wall so as to coincide with the angle between the first wall and second wall. Moreover, it is effective to prevent missing of one of these installation boards and prevent mounting of installation tools on wrong walls.

Preferably, the first installation board and second installation board have a same shape. In this constitution, when manufacturing these installation boards, the first installation board and second installation board can be manufactured by using a same die, and the manufacturing cost is saved, and error in combination of installation tools can be avoided.

Preferably, the first installation board and second installation board are linked to each other, and the boundary of the first installation board and second installation board can be folded. In this constitution, the first installation board and second installation board match with the angle of the first wall and second wall, and can be mounted on each wall, so that the air conditioner can be mounted easily on the wall according to the angle of the corner.

Preferably, it further comprises a step of mounting a third installation board having a third stopping part for engaging with a third engaging part provided in the top of the air conditioner main body on the ceiling. It moreover comprises a step, in which the first engaging part is engaged with the first stopping part, the second engaging part is engaged with the second stopping part, and the third engaging part is engaged with the third stopping part. In this Constitution, the strength of installation of the air conditioner main body is further enhanced.

Preferably, the first installation board, second installation board and third installation board are linked to each other, and each boundary of the first installation board, second installation board and third installation board can be folded. In this constitution, the first installation board, second installation board and third installation board match with each angle of the first wall, second wall and third wall, and can be mounted on each wall, so that the air conditioner can be mounted easily on the wall according to the angle of the corner.

Referring now to the drawings, exemplary embodiments of the invention are described in detail below.

Embodiment 1

FIG. 1 is a perspective view of installation of an air conditioner in an embodiment of the invention in a living room. An air conditioner main body 1 is installed closely to a corner of a ceiling 402 of the room and a first wall 403 and a second wall 404 in different directions. Inside the main body 1 are disposed a cross flow fan as a blower, a drive unit for rotating the cross flow fan, a heat exchanger, and a water pan for receiving the condensate from the heat exchange;. These constituent elements are same as in the prior art, and detailed description is omitted. An air diffuser 2 is provided at the front side of the main body 1. A wind direction changing device 3 is placed at the front side of the air diffuser 2. A suction grille 4 is fixed on the main body 1 through a suction grille frame 4 in the lower part of the main body 1.

Figure 2:
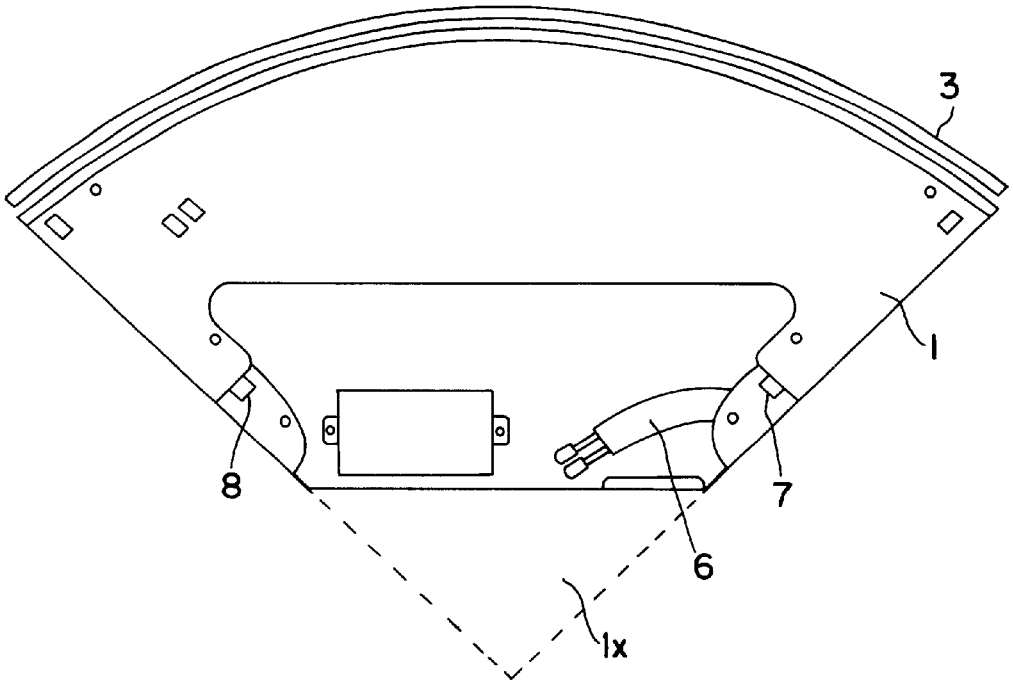
FIG. 2 is a bottom view of the air conditioner main body shown in FIG. 1.
Figure 3:
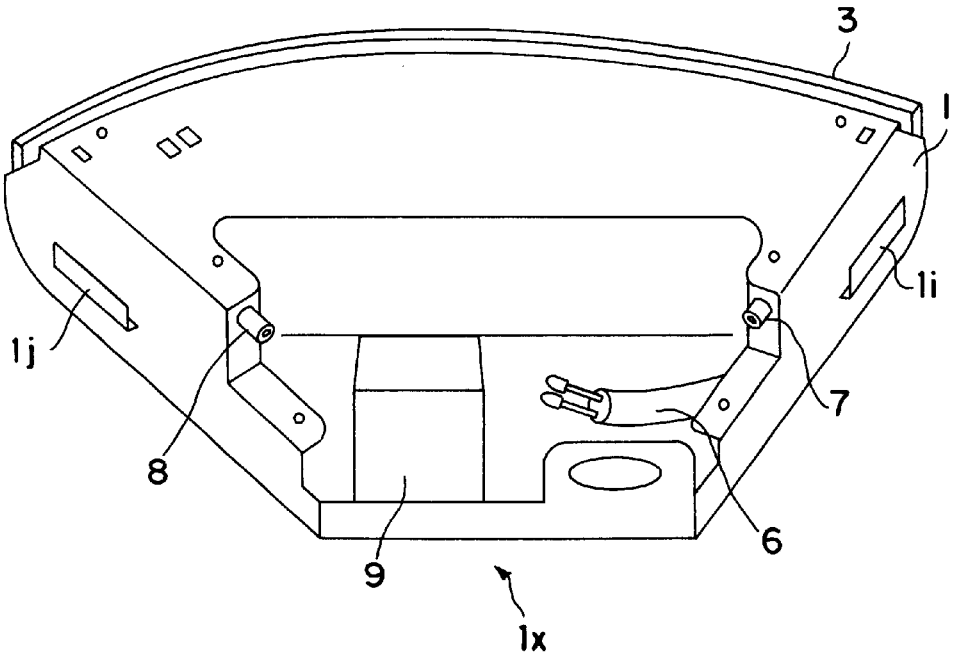
FIG. 3 is a perspective view from an oblique lower rear direction of the air conditioner main body shown in FIG. 1.

FIG. 2 is a bottom view of main body 1. FIG. 3 is a perspective view of the main body 1 as seen from an oblique lower rear direction. The main body 1 has a shape formed by cutting off a corner 1*x* of a nearly triangular form corresponding to the corner shape of the room. The leading end of a first connection piping 6 communicating with the heat exchanger is disposed so as to be close to the corner 1*x*. The position of the leading end may be projecting into the corner 1*x*. A first connection port 7 and a second connection port 8 are connection ports for connecting a drain hose for discharging the condensate generated from the heat exchanger collected in the water pan. The first connection port 7 and second connection port 8 are disposed so as to be positioned near the first wall 403 and second wall 404 and near the corner 1*x* after installation of the main body. The drain hose is connected to either the first connection port 7 or the second connection port 8. An electrical box 9 accommodates an electrical unit. The main body 1 also includes a first flange 1*i* and a second flange 1*j* for hooking.

Figure 4:
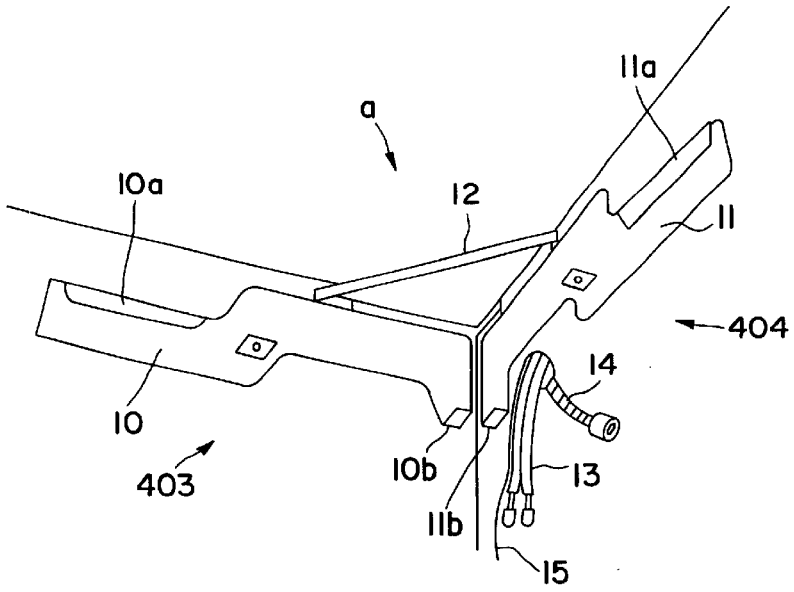
FIG. 4 is a perspective view showing a preparation state before mounting of the main body in an exemplary embodiment of the invention.
Figure 5:
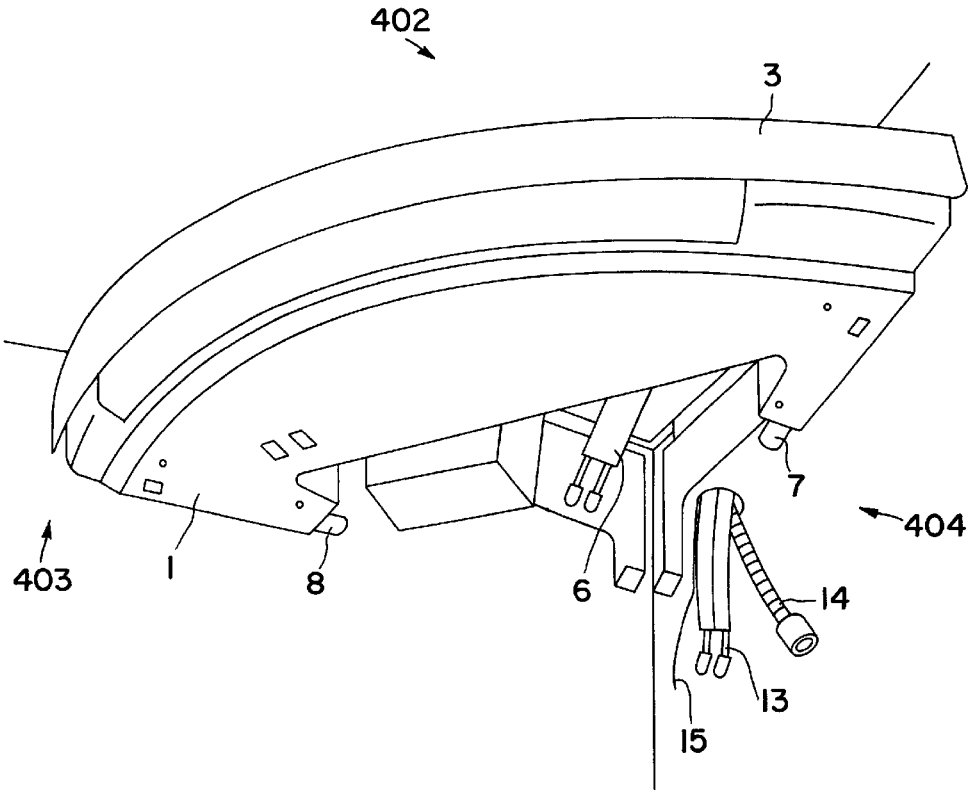
FIG. 5 is a perspective view in a state of installation of the main body after the state in FIG. 4.

Next is explained a mounting method of this air conditioner by referring to FIG. 4 and FIG. 5. FIG. 4 is a perspective view in ready state before mounting the main body 1. A first installation board 10 is mounted on the first wall 403 by means of screws, and a second installation board 11 is mounted on the second wall 404 by means of screws or the like. The first installation board 10 is engaged with the first flange 1*i*, and has a first support 10*a* for supporting the main body 1, and the second installation board 11 is engaged with the second flange 1*j* of the main body 1, and has a second support 11*a* for supporting the main body 1. An upper cover 12 is placed so as to cover above the portion corresponding to the corner 1*x* being cut off of the main body 1. A second connection piping 13 communicating with the outdoor unit, a drain hose 14, and the leading end of a connection wire 15 are prepared in a state projecting into the room from the second wall 404. FIG. 5 is a perspective view of mounting of the main body 1 after the ready state in FIG.

4. The first flange 1*i* is engaged with the first support 10*a*, and the second flange 1*j* is engaged with the second support 11*a*, and the main body 1 is supported by the installation boards 10, 11. Afterwards, the second connection piping 13 and first connection piping 6 are mutually connected, and the drain pipe 14 is connected to the first connection port 7. A lid is placed on the second connection port 8. The connection wire 15 is connected to the electrical unit 9. Then the suction grille is mounted on the main body 1. Thus, the installation of the air condition is completed as shown in FIG. 1.

In this constitution, before the main body 1 is mounted on the walls 403, 404, the second connection piping 13 and drain hose 14 are prepared in a state projecting from the second wall 404, so that the main body 1 is easily mounted on the walls 403, 404. Further, when the main body 1 is installed, since the cut-off corner 1*x* of the main body 1 is a free space, it is not required to install the second connection piping 13, drain hose 14 and connection piping 15 by penetrating through the main body 1 as required in the prior art. Accordingly, the working area for piping and wiring connection is wide. As a result, the connection work and installation work are easier.

After a series of connection works such as mounting of the main body 1 on the walls 403, 404, connection of the first connection piping 6 and second connection piping 13, connection of the drain hose 14 and first connection port 7, and connection of the connection wire 15 and main body, the suction grille is installed. Therefore, unlike the prior art, it is free from difficult work in a narrow space in a series of connection works by putting the hand in from the opening of the suction grille. As a result, the installation work of the air conditioner is extremely easy.

Further, after completion of installation of the air conditioner, the upper cover 12 is put on to cover the upper side of the space corresponding to the cut-off corner of the main body 1, so that invasion of dust can be prevented. Moreover, when transporting the parts of the air conditioner before assembling, since the main body 1 has a cut-off corner 1*x*, the package size is smaller. As a result, the transportation cost is saved, and it is extremely easy to carry.

In this embodiment, the second connection piping 13 and others are connected from the second wall 404 to the main body 1, but not limited to this, the second connection piping 13 can be also connected from the first wall 403 side, and same effects are obtained also in such a case.

Embodiment 2

Figure 6A:
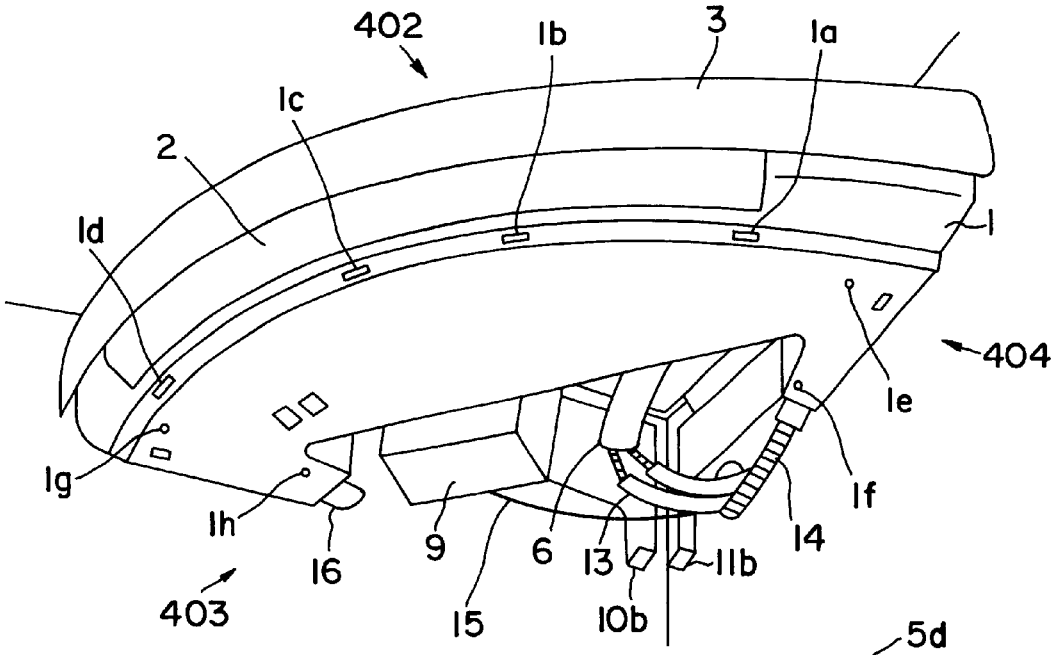
FIG. 6 is a perspective view of a second exemplary embodiment of the invention.
Figure 6B:
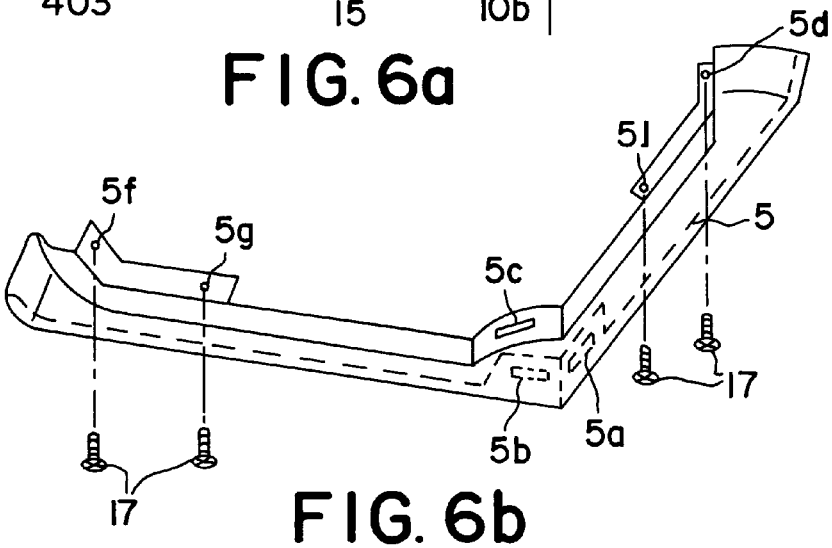
Figure 6C:
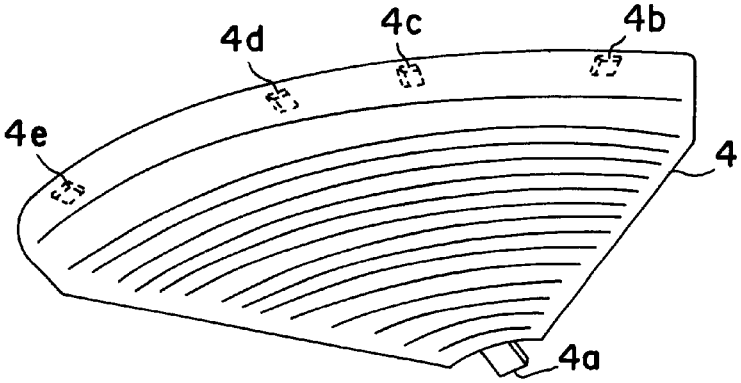

FIG. 6*a*, FIG. 6*b*, and FIG. 6*c* are perspective views showing the constitution for mounting of the suction grille. After installation of the main body 1, FIG. 6*a* shows the state finishing the connection of the second connection piping 13, drain hose 14, connection wire 15, and cap 16 (the cap on the second connection port 8 as mentioned in embodiment 1). FIG. 6*b* and FIG. 6*c* show the suction grille unit having a suction grille frame 5 and a suction grille 4. The suction grille frame 5 has a first engaging hole 5*a* to be engaged with a first bump 10*b* of a first installation board 10, a second engaging hole 5*b* to be engaged with a second bump 11*b* of a second installation board 11, and fourth holes 5*d*, 5*e*, 5*f*, 5*g* for fastening to the main body 1 with screws. As the first bump 10*b* is inserted into the first engaging hole 5*a*, and the second bump 10*b* is inserted into the second engaging hole 5*b*, the suction grille frame 5 is supported in the vertical direction at its inner side. Moreover, by joining screw holes 1*e*, 1*f*, 1*g*, 1*h* provided in the main body 1 with the fourth holes 5*d*, 5*e*, 5*f*, 5*g* by using screws 17, the suction grille frame 5 is fixed in the main body 1. As a third bump 4*a* is inserted into a third engaging hole 5*c* formed in the suction grille frame 5, the inner side of the suction grille 4 is fixed in the grille frame 5. As fourth bumps 4*b*, 4*c*, 4*d*, 4*e* are inserted into sixth engaging holes 1*a*, 1*b*, 1*c*, 1*d* provided beneath the air diffuser 2 of the main body 1, the front side of the suction grille 4 is fixed in the main body 1.

In this constitution, the inner part of the suction grille frame 5 that cannot be held by the main body 1 is held by the first installation board 10 and second installation board 11, so that the holding strength of the suction grille frame 5 is maintained sufficiently. Conventionally, it was difficult to match the relative positions of the installation boards 10, 11 and main body 1 after installation at high precision, but in the suction grille frame 5 in the constitution of the embodiment, only the vertical direction is held by the installation boards 10, 11, and the horizontal direction is held with a freedom to the installation boards 10, 11. Since the suction grille frame 5 is fixed and positioned in the main body 1 which is required to have positioning precision in the horizontal direction, the suction grille frame 5 is installed at an accurate positioning precision to the main body 1. Moreover, the holding strength including the inner sidle of the suction grille frame 5 is assured.

Embodiment 3

Figure 7:
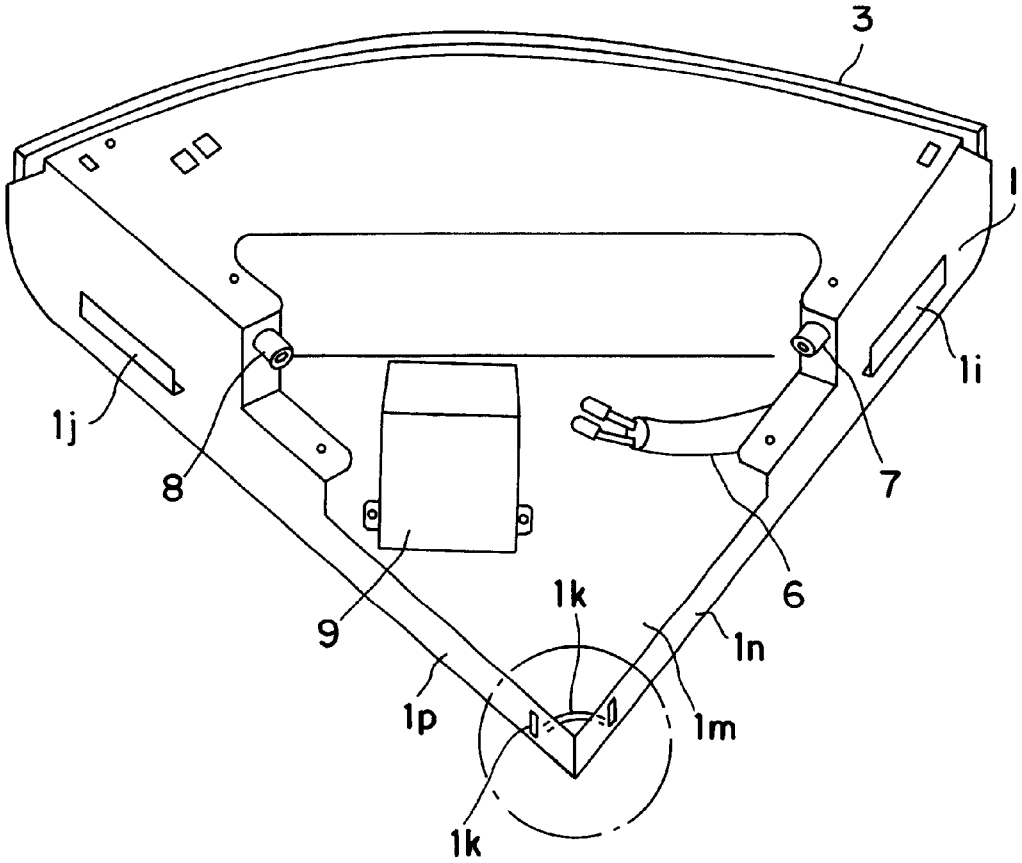
FIG. 7 is a perspective view from an oblique lower rear direction of a main body in a third exemplary embodiment of the invention.
Figure 8:
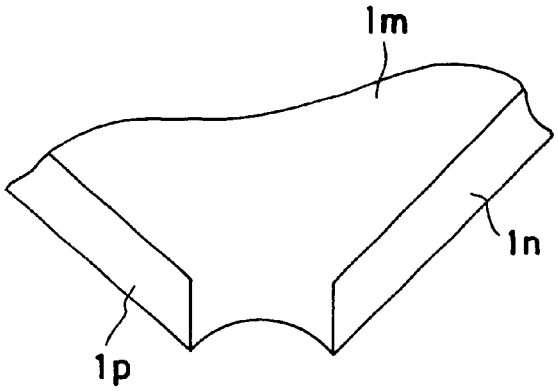
FIG. 8 is a perspective view of the third exemplary embodiment of the invention.

FIG. 7 is a perspective view of the main body 1 as seen from an oblique lower rear direction. The main body 1 has a corner in a shape being cut off, leaving only an upper part 1*m* and side upward parts 1*n*, 1*p* of the main body 1. That is, there is no lower part of the corner. A first slit k is formed in the remaining upper part 1*m* and side parts 1*n*, 1*p*. By twisting this slit 1*k*, or by cutting off the portions not connected through the slits, as shown in FIG. 8, the corner of the main body 1 can be cut off. In this embodiment, the separate upper cover as explained in embodiment 1 is not provided. Other constitution of the embodiment is same as in embodiment 1, and detailed description is omitted.

In this constitution, the corner is cut off, except for the upper part 1*m* and side upward parts 1*n*, 1*p* of the corner of the main body 1, and there is no lower part of the corner. Accordingly, the worker can work to connect and installed from the lower direction of the corner.

Also in this constitution, the upper cover 12 as used in embodiment 1 is not necessary, and therefore the number of parts is curtailed and the working efficiency is further enhanced.

Further, when installing the main body 1 in the room, if necessary, by twisting the first slit 1*k*, or by cutting off the portions not connected through the slits, the corner of the main body 1 can be cut off. Therefore, the second, connection piping 13 may be put in not only from the wall side as in FIG. 4., but also from the ceiling 402. As a result, the degree of freedom of installation method of the air conditioner is increased.

Incidentally, the first slit 1*k* may be also formed at a position slightly inside of the corner, in a range not disturbing the drawing operation of the second connection piping 13, and in this constitution, too, same effects are obtained.

Embodiment 4

Figure 9:
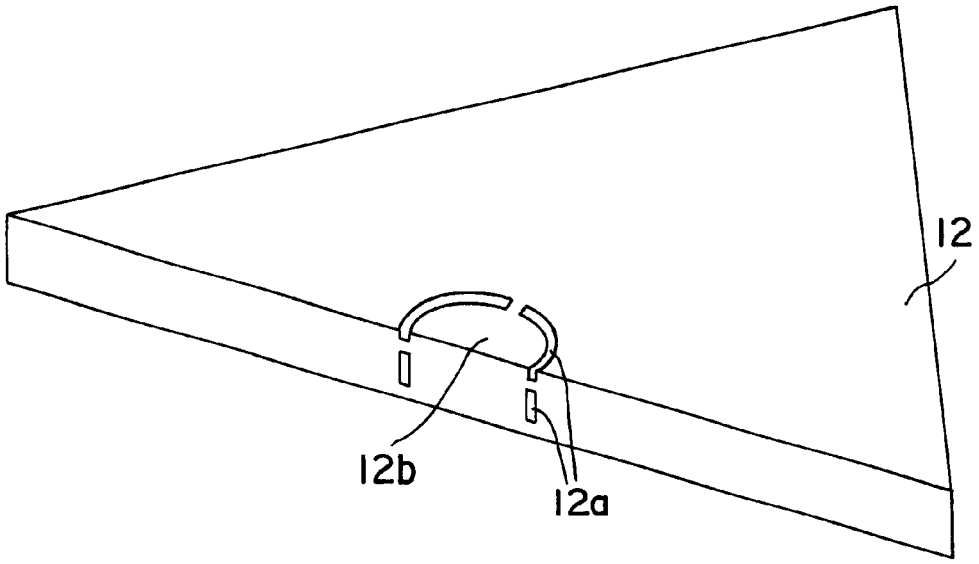
FIG. 9 is a perspective view of a fourth exemplary embodiment of the invention.
Figure 11:
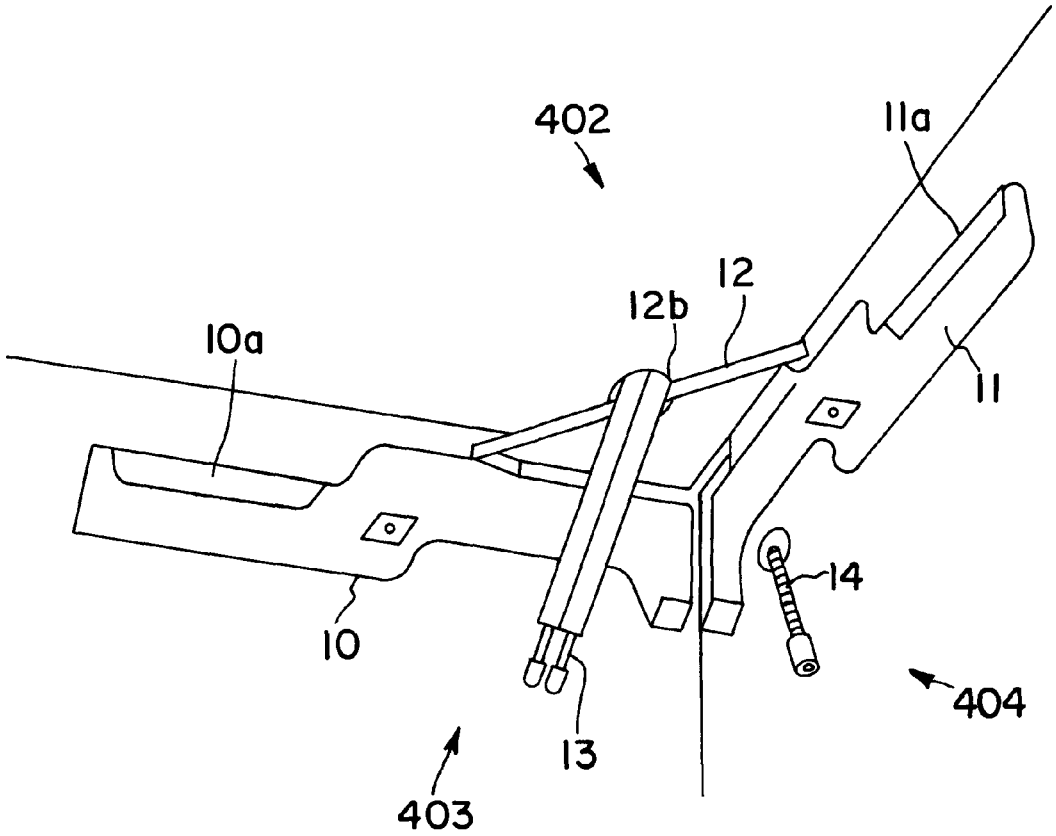
FIG. 11 is an oblique view of an intermediate mounting state in the fourth and fifth exemplary embodiments of the invention.

FIG. 9 shows other embodiment of the upper cover 12 explained in embodiment 1. A second slit 12*a* is formed in the upper cover 12. By twisting the second slit 12*a*, or by cutting off the portions not connected through the slits, a notch 12*b* is formed. FIG. 11 is a perspective view showing a state of drawing the second connection piping 13 in from the ceiling 402, by using the upper cover 12 having the notch 12*b*.

In this constitution, when installing the main body 1 in the room, if necessary, the notch 12*b* can be formed by cutting off the upper cover 12. The second connection piping 13 drawn out from the ceiling 402 can be taken in through the notch 12*b*, so that the degree of freedom of installation method of air conditioner is increased.

The position of the second slit 12*a* may be provided at a free position in a range not disturbing the operation for drawing in the second connection piping 13.

Embodiment 5

Figure 10:
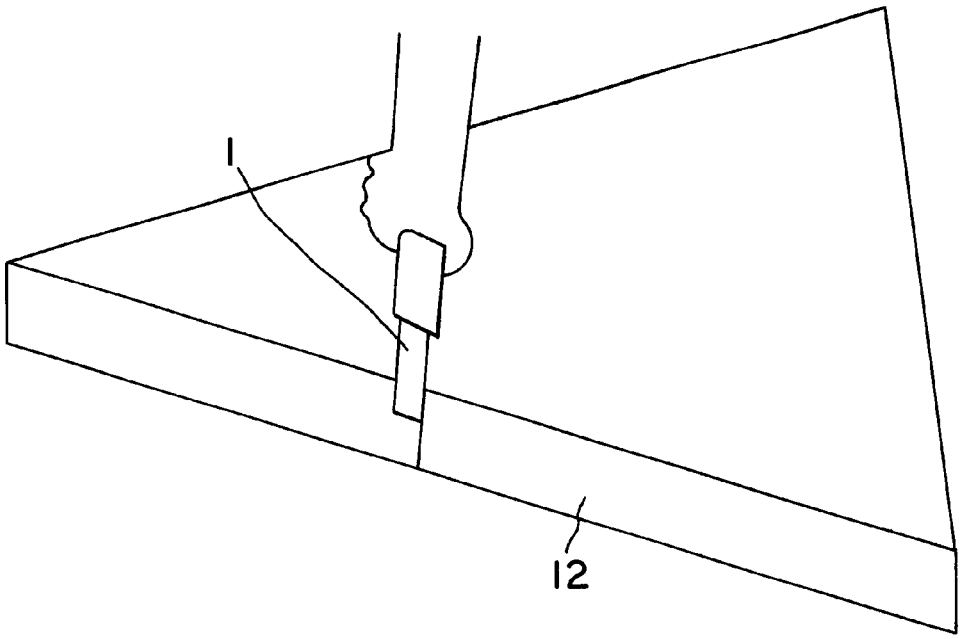
FIG. 10 is a perspective view of a fifth exemplary embodiment of the invention.

FIG. 10 shows a different embodiment of the upper cover 12 explained in embodiment 1. The upper cover 12 is made of resin or other material that can be cut and processed easily. The upper cover 12 can be easily cut off by using a knife 18 or the like. FIG. 11 is a perspective view showing a state of drawing the second connection piping 13 in from the ceiling 402, by using the upper cover 12 having such cut-off notch 12*b*. In this constitution, when installing the main body 1 in the room, if necessary, the upper cover 12 can be cut off in an arbitrary portion. Therefore, the second connection piping 13 can be taken in from the ceiling 402, so that the degree of freedom of installation method of air conditioner is increased.

Embodiment 6

Figure 12:
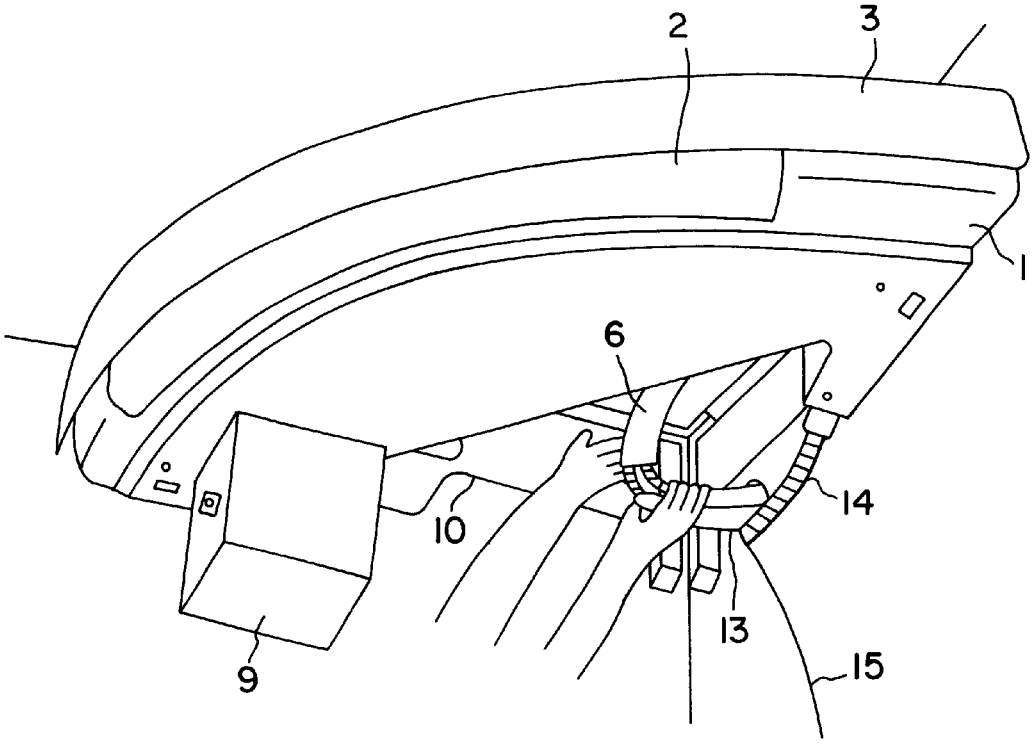
FIG. 12 is a perspective view of a sixth exemplary embodiment of the invention.
Figure 13:
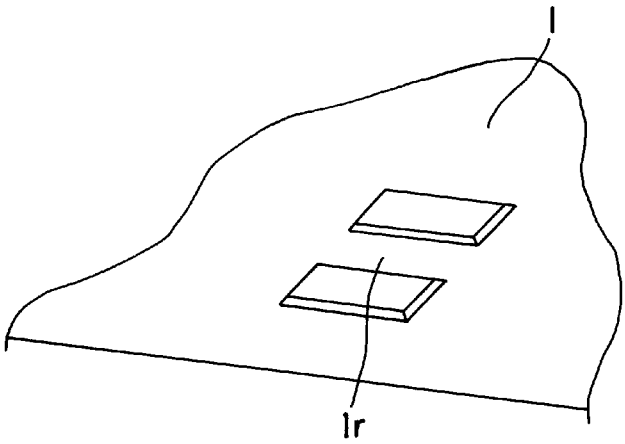
FIG. 13 is a perspective view of the sixth exemplary embodiment of the invention.
Figure 14:
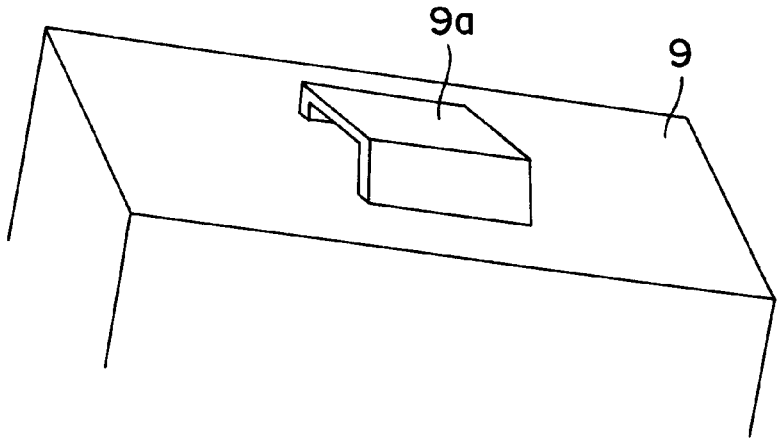
FIG. 14 is a perspective view of the sixth exemplary embodiment of the invention.

FIG. 12 is a perspective view showing a state of connection of first connection piping 6, second connection piping 13 and others by installing the main body 1 in the room. An electrical box 9 accommodates an electrical unit. A hooking claw 9*a* as shown in FIG. 14 is formed on the electrical box 9. At the lower side of the main body 1, on the other hand, stopping means 1*r* for hooking the hooking claw 9*a* is provided as shown in FIG. 13. That is, in the state in FIG. 12, by applying the hooking claw 9*a* on the stopping means 1*r* which is a provisional holder, the electrical box 9 is provisionally held in the main body 1. In this slate, the first connection piping 13 and drain hose 14 are connected. After completion of these connection jobs, the electrical box 9 is returned to the position as shown in FIG. 5 or FIG. 6, and the connection wire 15 is connected to the electrical unit. Then, the suction grille is attached to complete the installation.

Therefore, when connecting the connection piping and others, the electrical box 9 can be temporarily moved away from the working area, the working space is widened, so that the working efficiency is enhanced.

Embodiment 7

Figure 15:
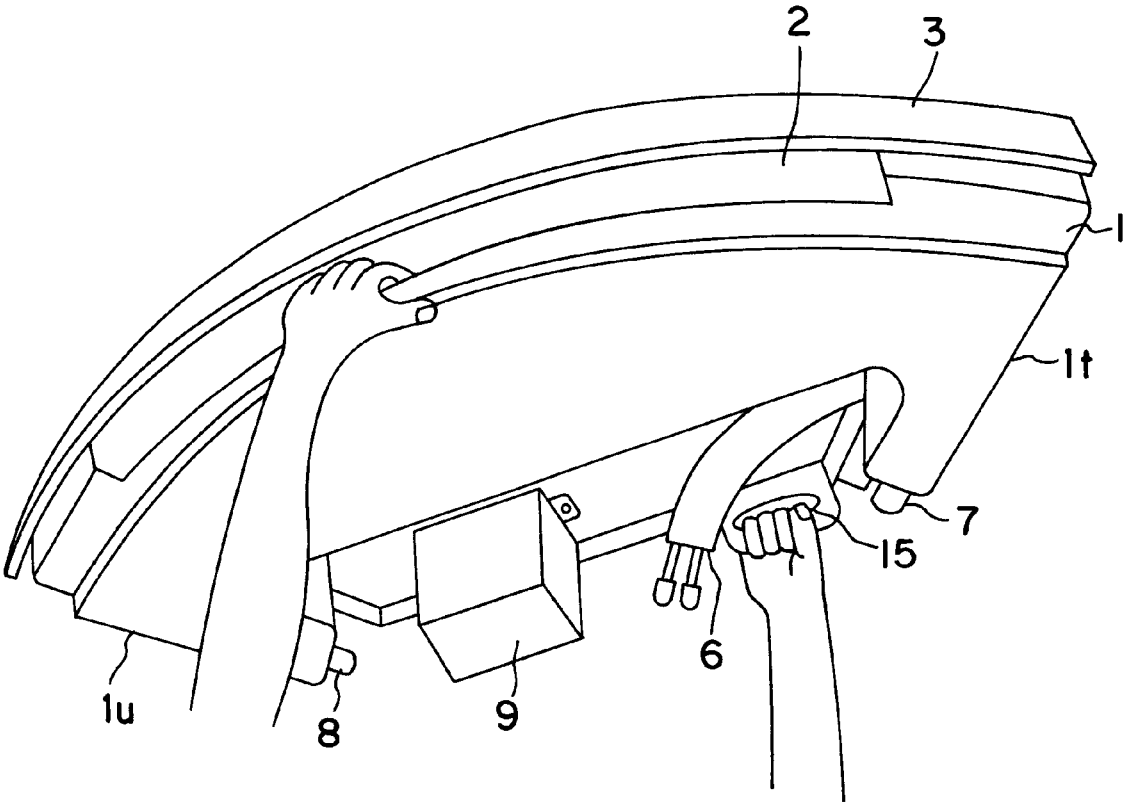
FIG. 15 is a perspective view of a seventh exemplary embodiment of the invention.

FIG. 15 is a perspective view showing a lifted state of the main body 1, in order to mount the main body 1 by hooking on the first installation board 10 and second installation board 11, in the state in FIG. 4 finishing the preparation before installing the main body 1 in the room. A first handle 1*s* is provided at the inner side of the main body 1. The worker holds this first handle 1*s* and the air diffuser 2, and lifts the main body 1, and fixes the main body 1 by hooking on the installation boards 10, 11.

If the first handle 1*s* is not provided, for lifting the main body 1, the worker installs the main body 1 closely to the wall while lifting the sides 1*t*, 1*u* of the main body 1. In this case, the worker must install the main body 1 while changing the holding positions of the main body 1. In this constitution, however, the worker can install the main body 1 securely in the room without having to changing the holding positions of the main body 1.

Embodiment 8

Figure 16:
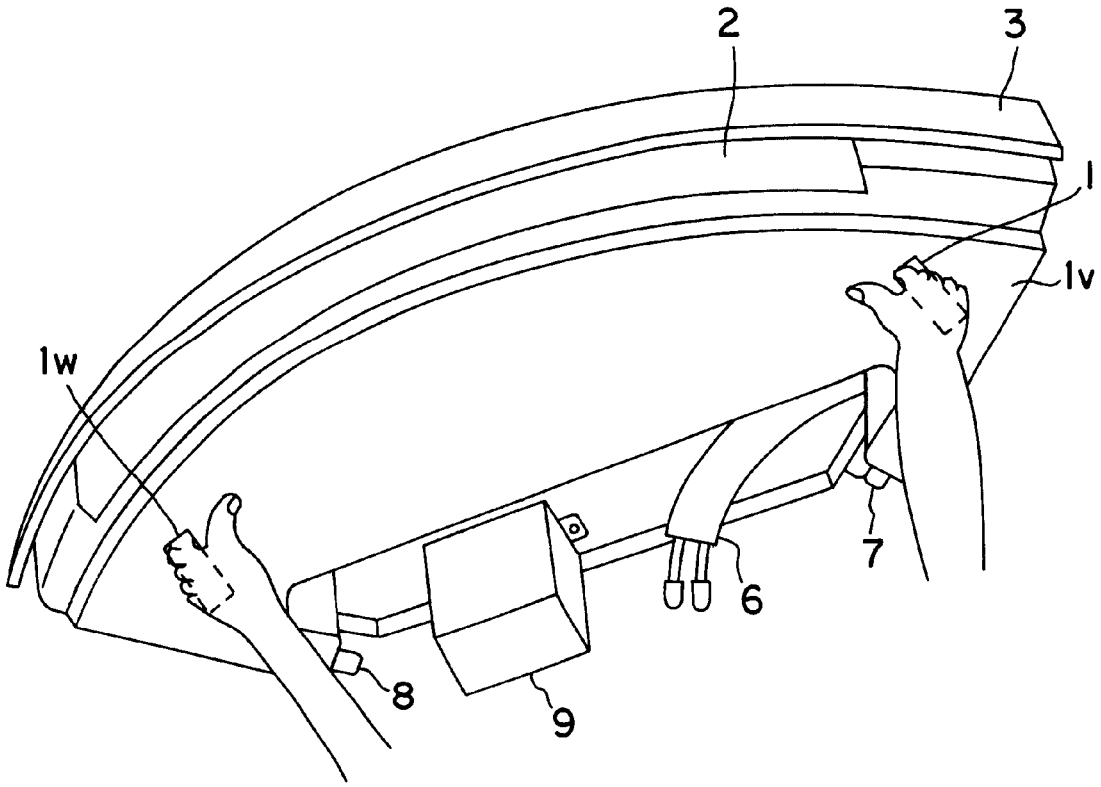
FIG. 16 is a perspective view of an eighth exemplary embodiment of the invention.

FIG. 16 is, a perspective view of other embodiment in a lifted state of the main body 1 same as in FIG. 15. A first handle 1*v* and a second handed 1*w* are provided at the lower side of the main body 1. The worker holds the first handle 1*v* and second handle 1*w*, and can fix the main body 1 by hooking on the installation boards while lifting the main body 1.

In this constitution, as mentioned in embodiment 7, the main body 1 can be securely lifted and installed in the room without having to change the holding positions of the main body 1.

Embodiment 9

Figure 17:
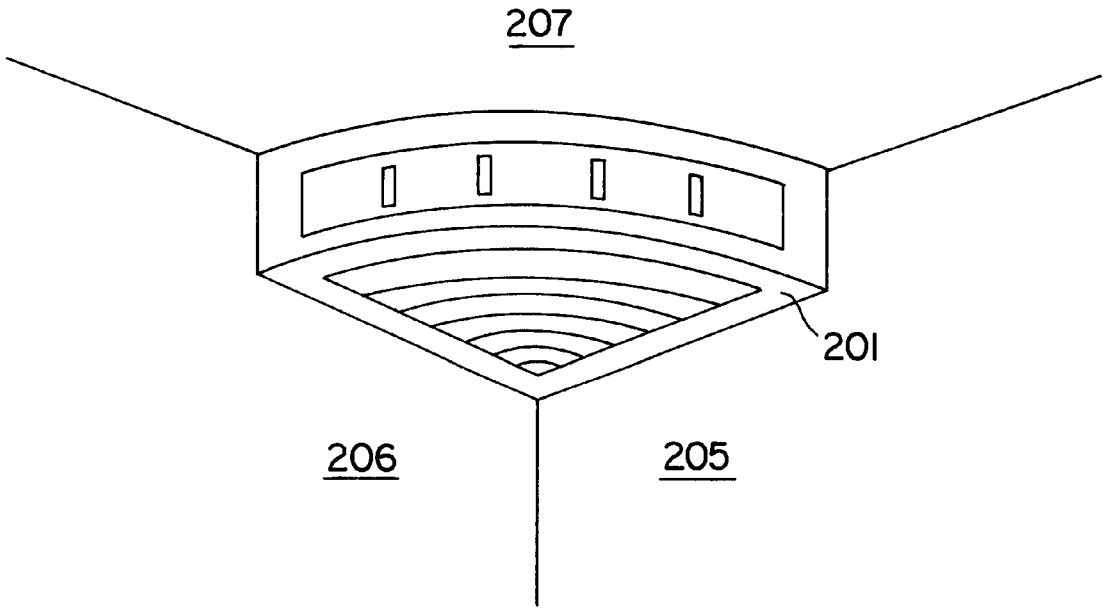
FIG. 17 is a perspective view of an air conditioner showing a ninth exemplary embodiment of the invention.
Figure 18:
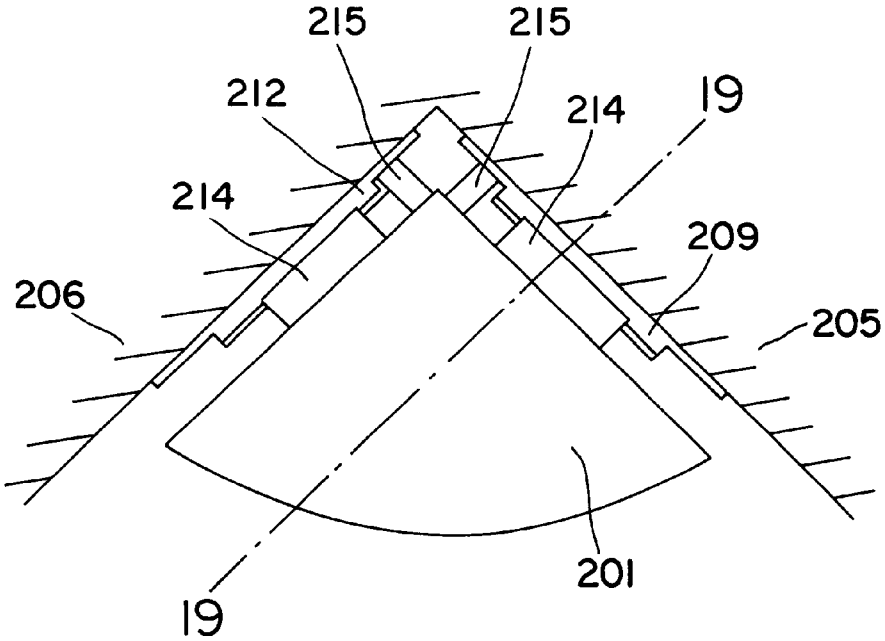
FIG. 18 is a front view of FIG. 17 as seen from the ceiling side.
Figure 19:
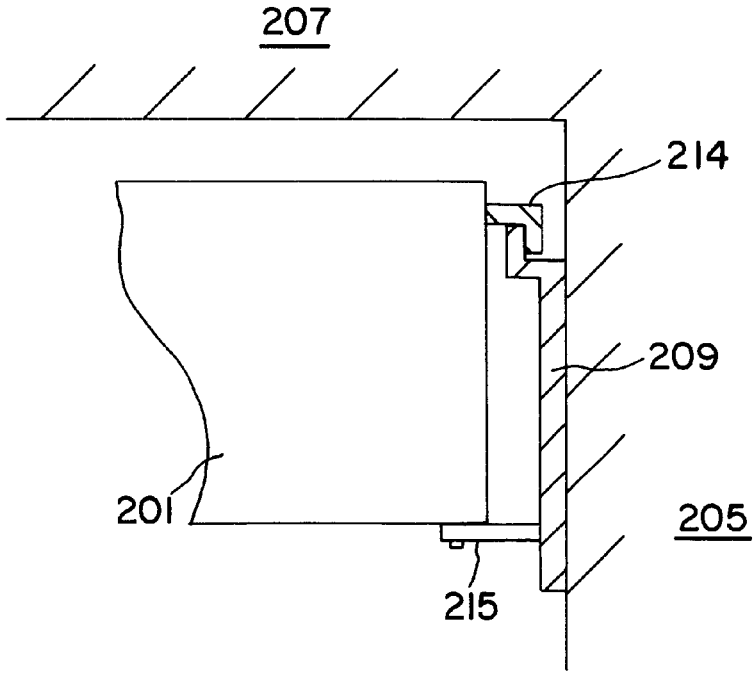
FIG. 19 is a sectional view along line 19—19 in FIG. 18.
Figure 20:
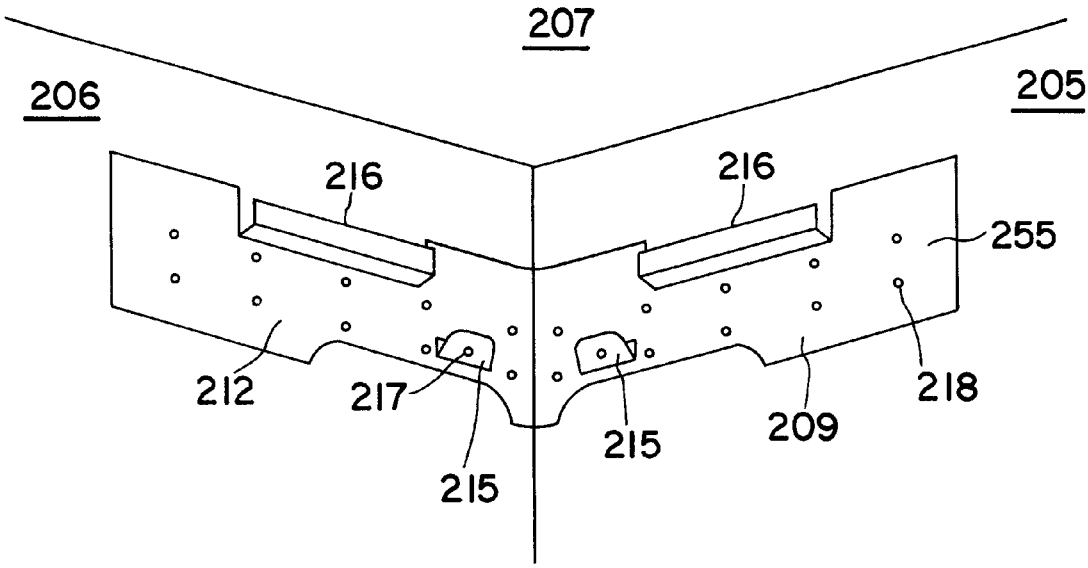
FIG. 20 is a perspective view of mounting of installation board.

An installation tool in embodiment 9 of the invention is described while referring to FIG. 17 through FIG. 21. FIG. 17 is a perspective view of installation of an air conditioner in a space to be conditioned. FIG. 18 is a plan view of FIG. 17 as seen from the ceiling side. FIG. 19 is a sectional view of FIG. 18 along line 19—19. FIG. 20 is a perspective e view of mounting of installation board of wall.

Figures 21A, 21B:
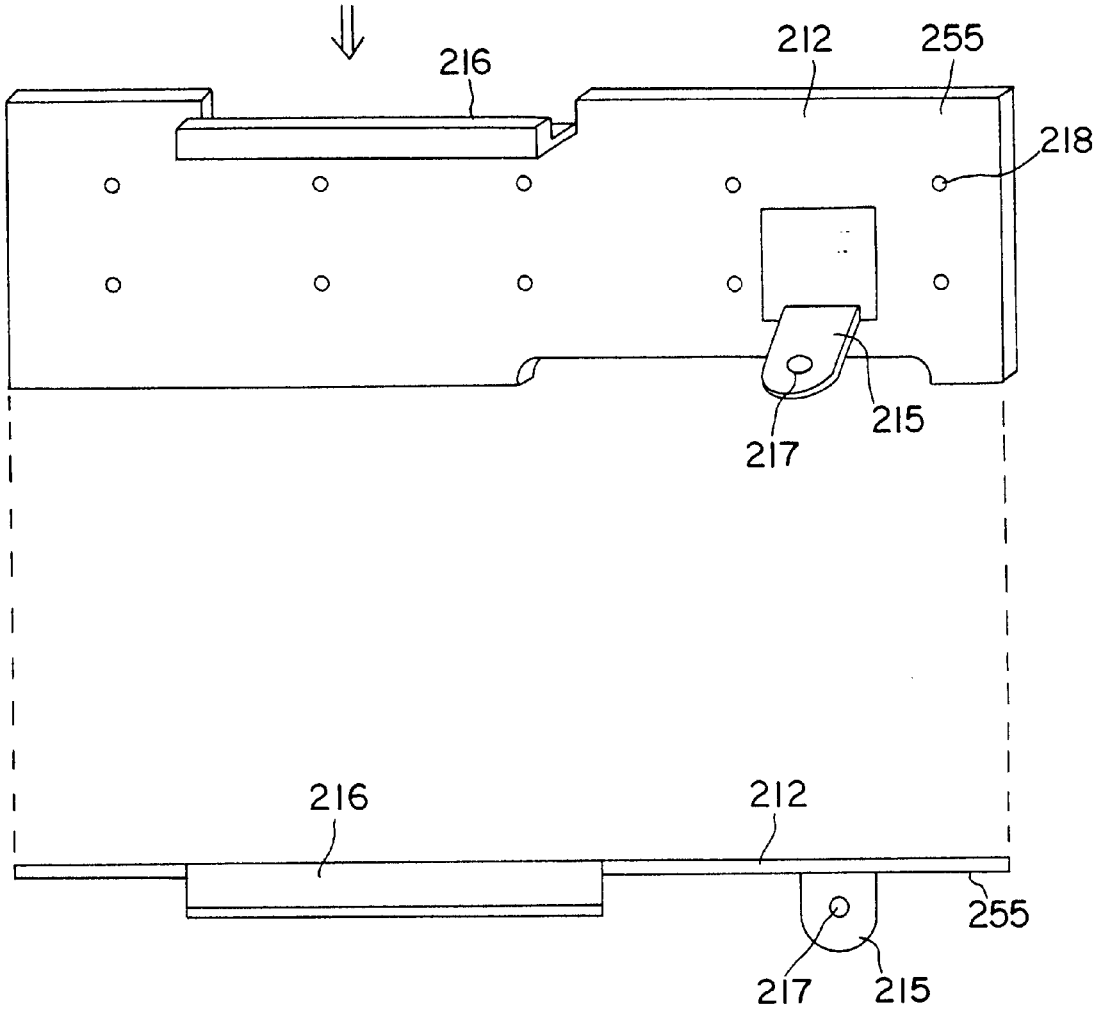
FIG. 21(*a*) is a detailed drawing of an installation tool.

Each one of a first installation board 212 and a second installation board 209 has a base part 255, a stopping part 216, and a fixing part 215. A plurality of screw holes 218 are formed in the base part 255. An air conditioner main body 201 is installed at a position closer to a ceiling 207 at a corner of a first wall 206 and a second wall 205 in a room. The main body 201 is installed at the corner by using a first installation board 212 and a second installation board 209 having a plurality of screw holes 218. The first installation board 212 is mounted on the first wall 206 through the screw holes 218, and the second installation board 209 is mounted on the second wall 205 through the screws 218. FIG. 21 is a detailed diagram of the first installation board 212. A stopping part 216 is provided for hooking an engaging part 214 at the side of the air conditioner main body 201. By hooking the engaging part 214 on the stopping part 216 from above, the air conditioner main body 201 is fixed in place. The second installation board 209 has a same constitution as the first installation board 212. The air conditioner main body 201 is fixed on the walls 205, 206 by using the both first installation board 212 and second installation board 209.

Each one of the first installation board 212 and second installation board 209 has a fixing part 215 having a screw hole 217. As this fixing part 215 is tightened together with the lower side of the air conditioner main body 201 through screws, the air conditioner main body 201 is finally fixed at a desired position.

In this constitution, the air conditioner main body 201 can be installed at the corner of the space to be conditioned between the first wall 206 and second wall 205. Therefore, it does not require complicated process of installation such as suspension from the ceiling, and it can be easily installed at the corner. Moreover, since the main body 201 is supported by two walls, the strength of installation is extremely enhanced.

Also in this constitution, preferably, the screw holes 217 of the fixing part 215 have an oval shape. According to this constitution, if the angle of the first wall 206 and second wall 205 is not a right angle, or if the positions of the main body 201 and screw holes 217 are deviated, the position of the main body 201 can be fine adjusted, and the degree of freedom of installation at the corner is enhanced.

Embodiment 10

Figure 22A:
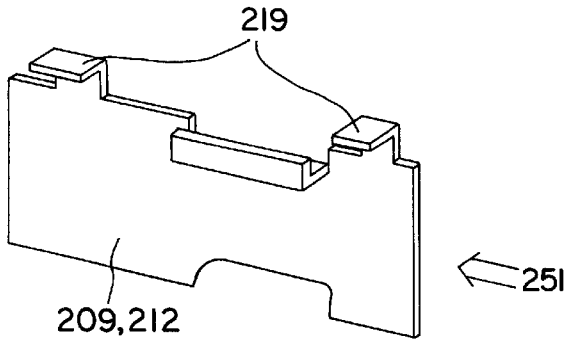
FIG. 22(*a*) is a perspective view of an installation board of a tenth embodiment of the invention.
Figure 22B:
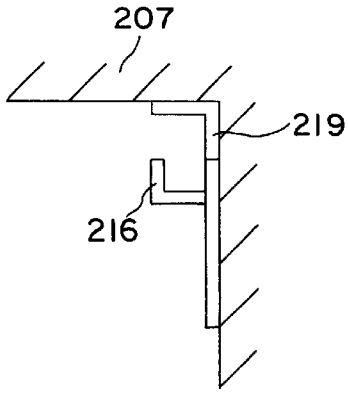
Figure 22C:
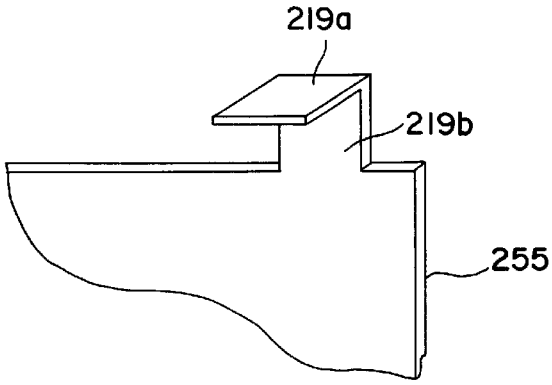

Embodiment 10 of the invention is described below while referring to FIG. 22(*a*) to FIG. 22(*c*). FIG. 22(*a*) is a perspective view of an installation board of the embodiment, FIG. 22(*b*) is a plan view of the installation board as seen from the lateral direction 251, and FIG. 22(*c*) is a magnified view of a horizontal setting part 219.

Each one of the upper ends of the first installation board 212 and second installation board 209 has a horizontal setting part 219 of a nearly L-shape projecting upward in the base part 255. As shown in FIG. 22(*c*), the horizontal setting part at 19 has an L-shape composed of a horizontal setting plane 219*a* and a vertical plane 219*b*, and the horizontal setting plane 219*a* has an angle of about 90 degrees to the base part 255. While the horizontal setting plane 219*a* is abutting against the ceiling 207 or other structural part as the basis of levelness such as turning edge (not shown), the first installation board 212 and second installation board 209 are mounted on the first wall 206 and second wall 205 with screws through screw holes 18.

In this constitution, when mounting the first installation board 212 and second installation board 209 on the first wall 206 and second wall 205, it is possible to determine the levelness to the ceiling 207 without using level, angle gauge or other tool, so that the air conditioner main body 201 can be installed horizontally on the ceiling.

In this embodiment, the horizontal setting part 219 may be also placed at the lower part of the first installation board 212 and second installation board 209, and the same effects are obtained also in such constitution. Alternatively, without placing the horizontal setting plane 219*a*, only the vertical plane 219*b* may be placed, and the vertical plane 219*b* may be shaped so that the upper surface of the vertical plane 219*b* may contact linearly or contact by point with the ceiling 207. In such constitution, too, same effects are obtained.

Embodiment 11

Figure 23A:
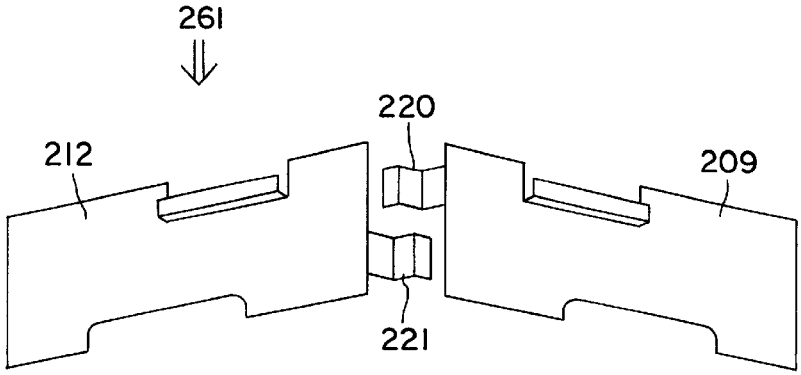
FIG. 23 (*a*) is a perspective view of an installation board of an eleventh exemplary embodiment of the invention.
Figure 23B:
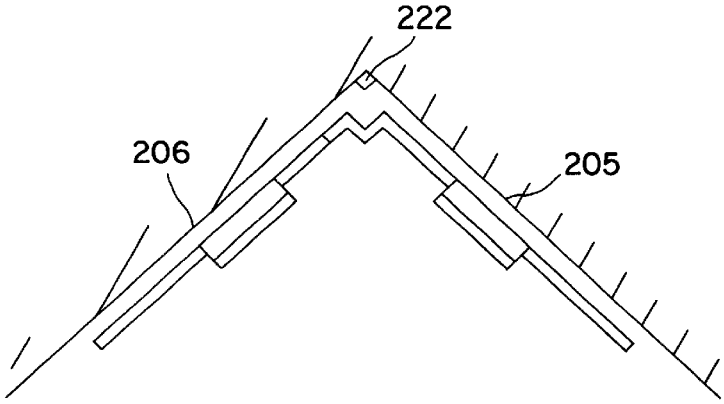
Figure 23C:
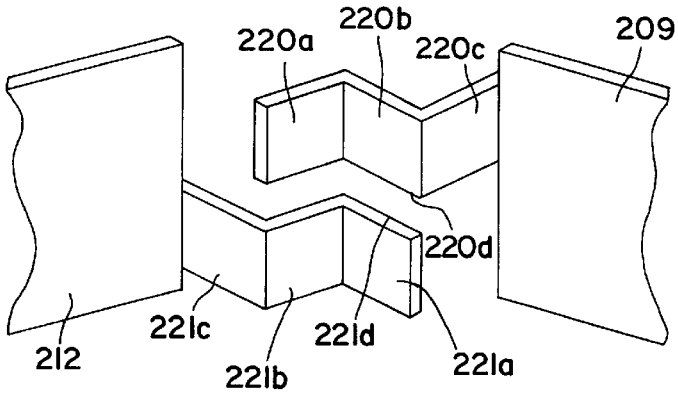

Embodiment 11 of the invention is described below while referring to FIG. 23(*a*) to FIG. 23(*c*). FIG. 23(*a*) is a perspective view of embodiment 11 of the invention, FIG. 23(*b*) is a plan view as seen from the direction of arrow 261, and FIG. 23(*c*) is a magnified view of a mounting position setting part 220.

A first mounting position setting part 221 is placed at the end of the side of the first, installation board 212 adjacent to the second installation board 209, and a second mounting position setting part 220 is placed at the end of the side of the second installation board 209 adjacent to the first installation board 212. The second mounting position setting part 220 has a shape of stairs consisting of a second mounting position setting plane 220*a*, a second mounting position setting vertical plane 220*b*, and a second mounting position setting part mounting plane 220*c*, and the second mounting position setting vertical plane 220*b* forms an angle of about 90 degrees together with the second mounting position setting plane 220*a* and second mounting position setting part mounting plane 220*c*, and the second mounting position setting part mounting plane 220*c* forms an angle of 90 degrees to the first installation plane 212. The first mounting position setting part 221 of the first installation board 212 also has a symmetric shape same as the second mounting position setting part 220. A lower horizontal plane 220*d* of the second mounting position setting part 220 and an upper horizontal plane 221*d* of the first mounting position setting part 221 are installed at positions deviated vertically so as to contact with each other. With the second mounting position setting plane 220*a* of the second mounting position setting part 220 contacting with the first wall 206, the second installation board 209 is mounted on the second wall 205 through the screw hole 218 of the second installation board 209. With the first mounting position setting plane 221*a* of the first mounting position setting part 221 contacting with the second wall 205, the first installation board 212 is mounted on the first wall 206 through the screw hole 218 of the first installation board 212.

In this constitution, when mounting the installation boards 212, 209 on the walls 206, 205, the installation boards 212, 209 can be mounted at specified positions corresponding to the intersecting line of the first wall 206 and second wall 205.

In the constitution, since the mounting position setting parts 220, 221 are shaped like stairs, if there is a protrusion 222 at a corner edge of the room, the mounting position setting parts 220, 221 can be placed at the corner edge while avoiding such protrusion 222. Therefore, the air conditioner can be easily installed at a coiner edge of the room. Incidentally, the vertical configuration of the first mounting position setting part 221 and second mounting position setting part 220 is not particularly limited, and same effects are obtained in any case.

Without installing the mounting position setting planes 220*a*, 221*a*, the constitution may be also realized by the mounting position setting vertical planes 220*b*, 221*b* and mounting position setting part mounting planes 220*c*, 221*c* alone. In this case, linear parts are formed in the mounting position setting parts 220, 221 so that the ends of the mounting position setting vertical planes 220*b*, 221*b* may linearly contact with the walls 205, 206. Alternatively, bumps are formed on the mounting position setting parts 220, 221 so that the ends of the mounting position setting vertical planes 220*b*, 221*b* may contact by point with the walls 205, 206. Such constitution also brings about similar effects. Also by using the horizontal setting parts 219 shown in embodiment 10 together with the mounting position setting parts 220, 221, the air conditioner main body 201 may be easily mounted horizontally on the ceiling 207.

Embodiment 12

Figure 24A:
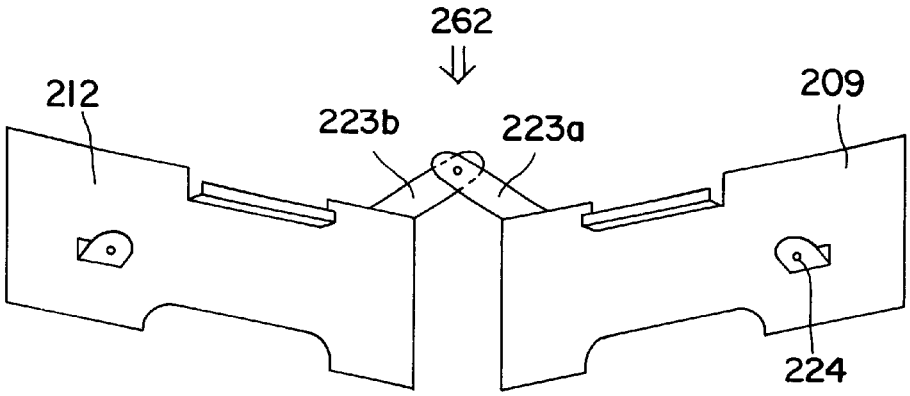
FIG. 24(*b*) is a perspective view of an installation board of a twelfth exemplary embodiment of the invention.
Figure 24B:
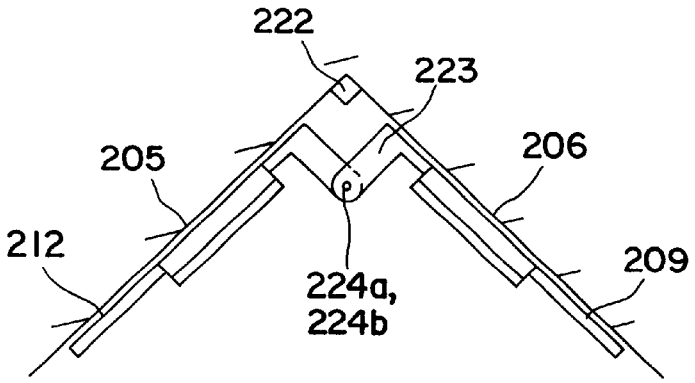
Figure 24C:
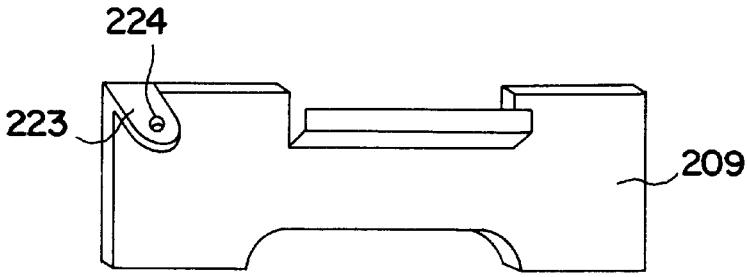

Embodiment 12 of the invention is described below while referring to FIG. 24(*a*), FIG. 24(*b*), and FIG. 24(*c*). FIG. 24(*a*) is a perspective view of embodiment 12 of the invention, FIG. 24(*b*) is a plan view of FIG. 24(*a*) as seen from the direction of arrow 262, and FIG. 24(*c*) is a detail view of a second installation board.

A second rotary part 223*a* extending to the air conditioner main body side is provided at the upper end of a second installation board 209, and a first rotary part 223*b* is similarly disposed at a first installation board 212. Each one of the second rotary parts 223*a* and first rotary part 223*b* has a second hole 224*a* and a first hole 224*b* for mutually coupling the second rotary part 223*a* and first rotary part 223*b*. The first hole 224*b* and second hole 224*a*are matched and coupled with screws. In this constitution, the first installation board 212 and second installation board 209 can rotate about the coupled holes 224*a*, 224*b*. Therefore, if the corner angle of the first wall 206 and second wall 205 is not exactly a right angle of 90 degrees, each upper end of the first installation board 212 and second installation board 209 can be set at a same height, and missing of one of the installation boards can be prevented, and mounting of installation boards on wrong walls can be also prevented.

In this embodiment, the rotary parts 223*a* 223*b* are placed only at the upper ends of the first installation board 212 and second installation board 209, but not limited to this constitution, the rotary parts 223*a*, 223*b* may be disposed at both upper end and lower end, and this constitution extremely increases the strength to withstand the torsional force from outside.

Embodiment 13

Figure 25:
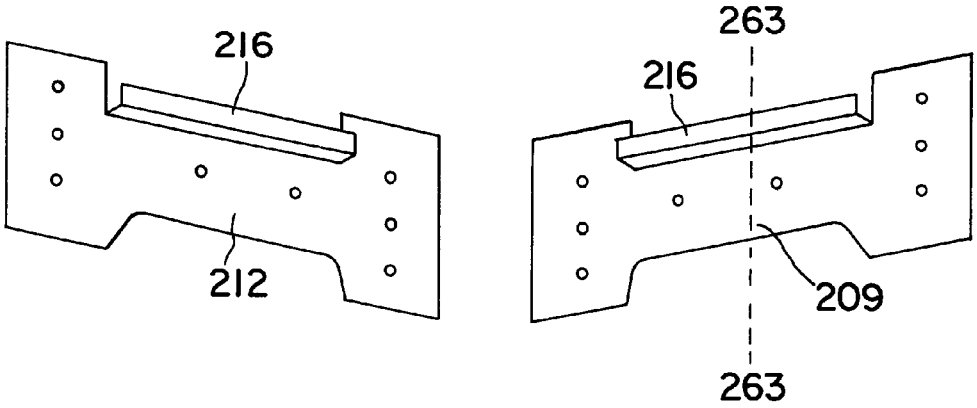
FIG. 25 is a perspective view of an installation board of a thirteenth exemplary embodiment of the invention.

Embodiment 13 of the invention is described below while referring to FIG. 25. FIG. 25 is a perspective view of embodiment 13 of the invention. A second installation board 209 and a first installation board 212 mutually have symmetric shapes to the central line 263—263. In this constitution, when the first installation board 212 and second installation board 209 are manufactured by plastic forming or plate making, the die can be commonly shared. As a result, the manufacturing cost is saved. Moreover, mismatching of the first installation board and second installation board can be avoided. Still more it is also possible to realize a constitution extended in the length of the stopping part 216, or a constitution in which the stopping part 216 has a plurality of stopping parts, and such constitution increases the strength of installation of the air conditioner main body.

Embodiment 14

Figure 26A:
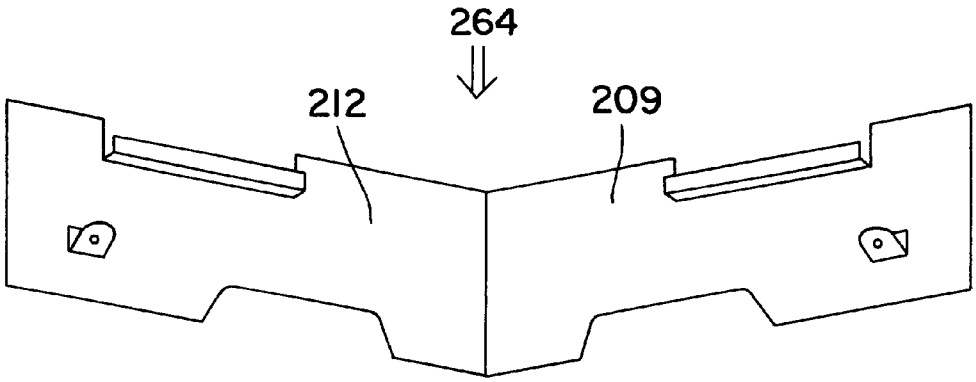
FIG. 26(*a*) is a perspective view of an installation board of a fourteenth exemplary embodiment of the invention.
Figure 26B:
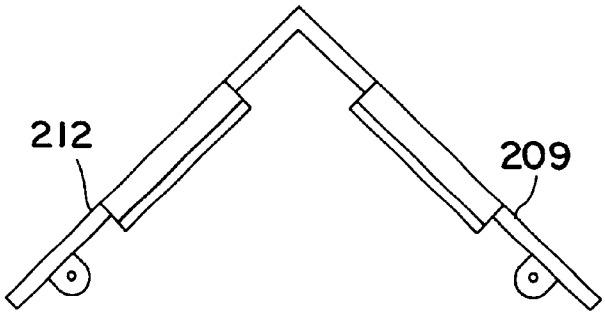

Embodiment 14 of the invention is described below while referring to FIG. 26. FIG. 26(*a*) is a perspective view of embodiment 14 of the invention, and FIG. 26(*b*) is a plan view as seen from the direction of arrow 264. A first installation board 212 and a second installation board 209 are formed in one body, instead of separate pieces, and moreover the boundary of the first installation board 212 and second installation board 209 can be folded. In this constitution, according to the angle of the wall of the corner edge of the room, the air conditioner can be installed at the corner edge.

Embodiment 15

Figure 27A:
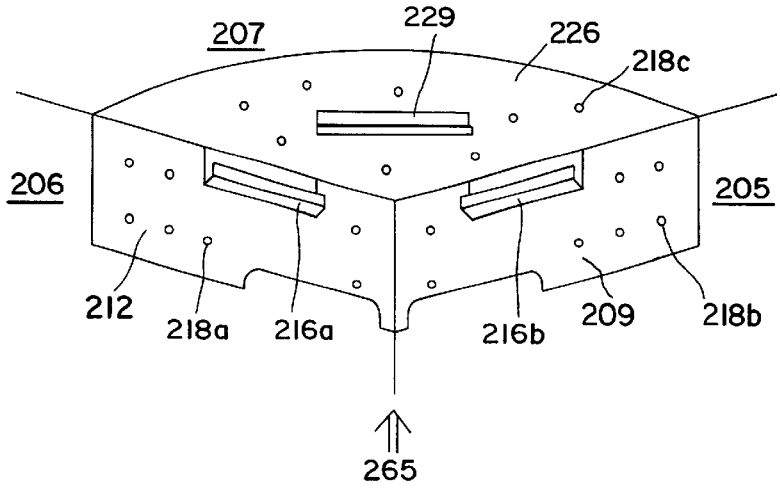
FIG. 27(*a*) is a perspective view of an installation board of a fifteenth exemplary embodiment of the invention.
Figure 27B:
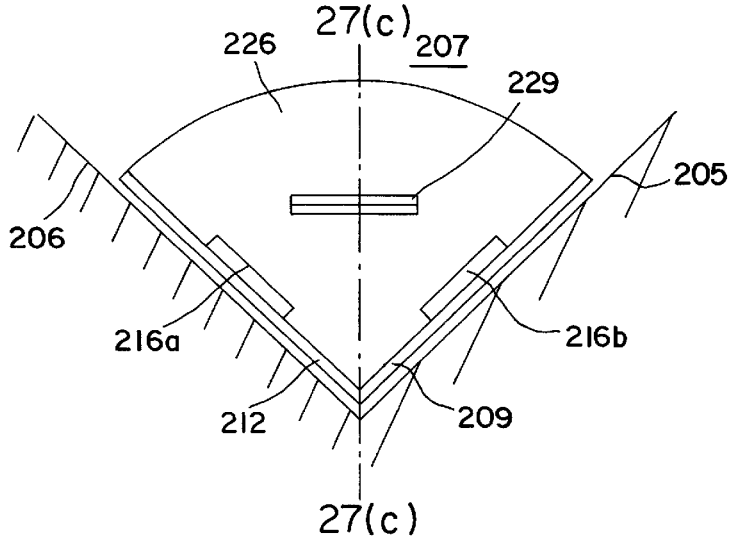
Figure 27C:
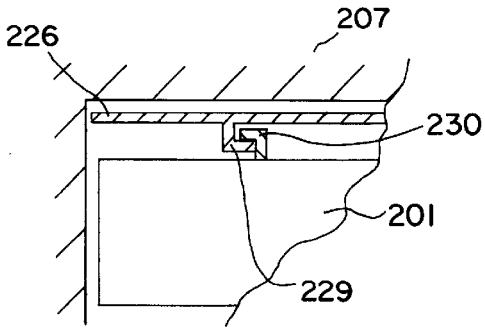
Figure 28:
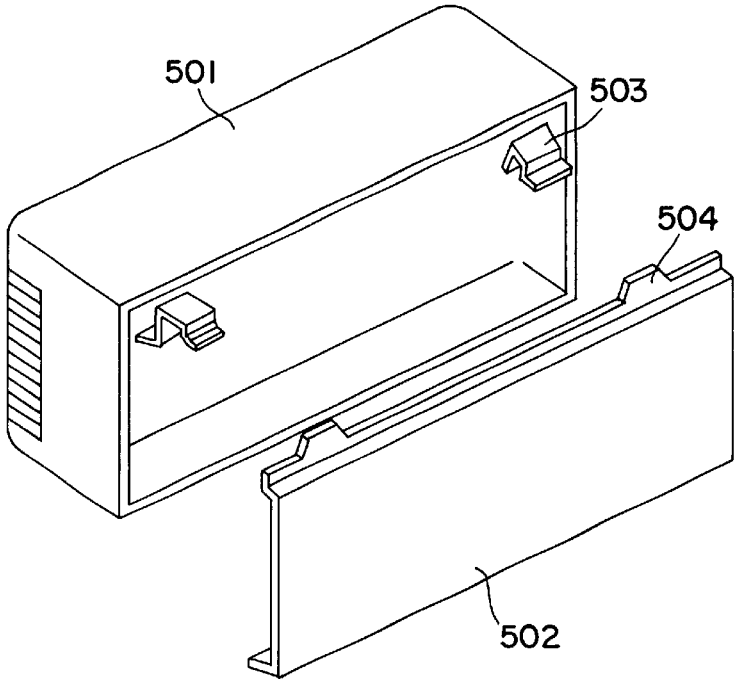
FIG. 28 PRIOR ART
FIG. 28 i; an explanatory diagram showing an installation tool of a conventional air conditioner.
Figure 29:
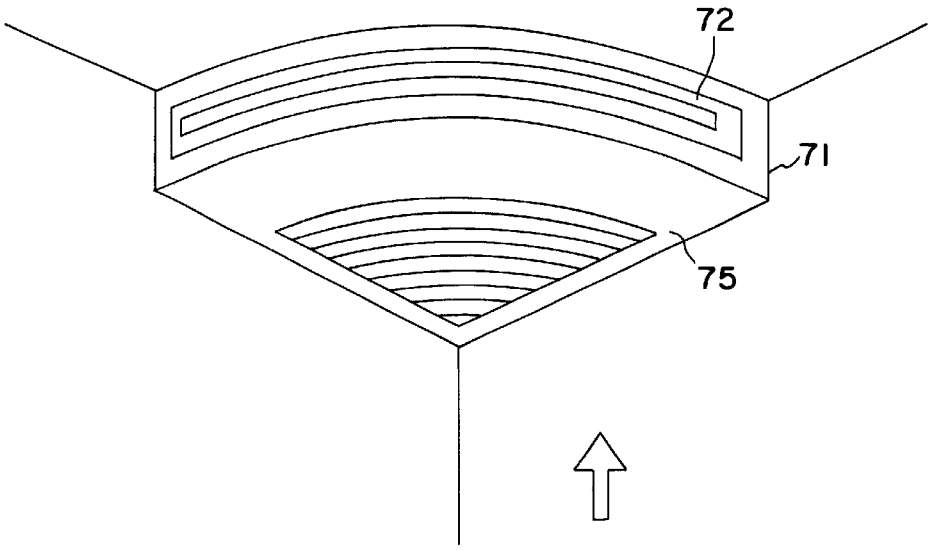
FIG. 29 PRIOR ART
FIG. 29 is a perspective view of an air conditioner showing a prior art.
Figure 30:
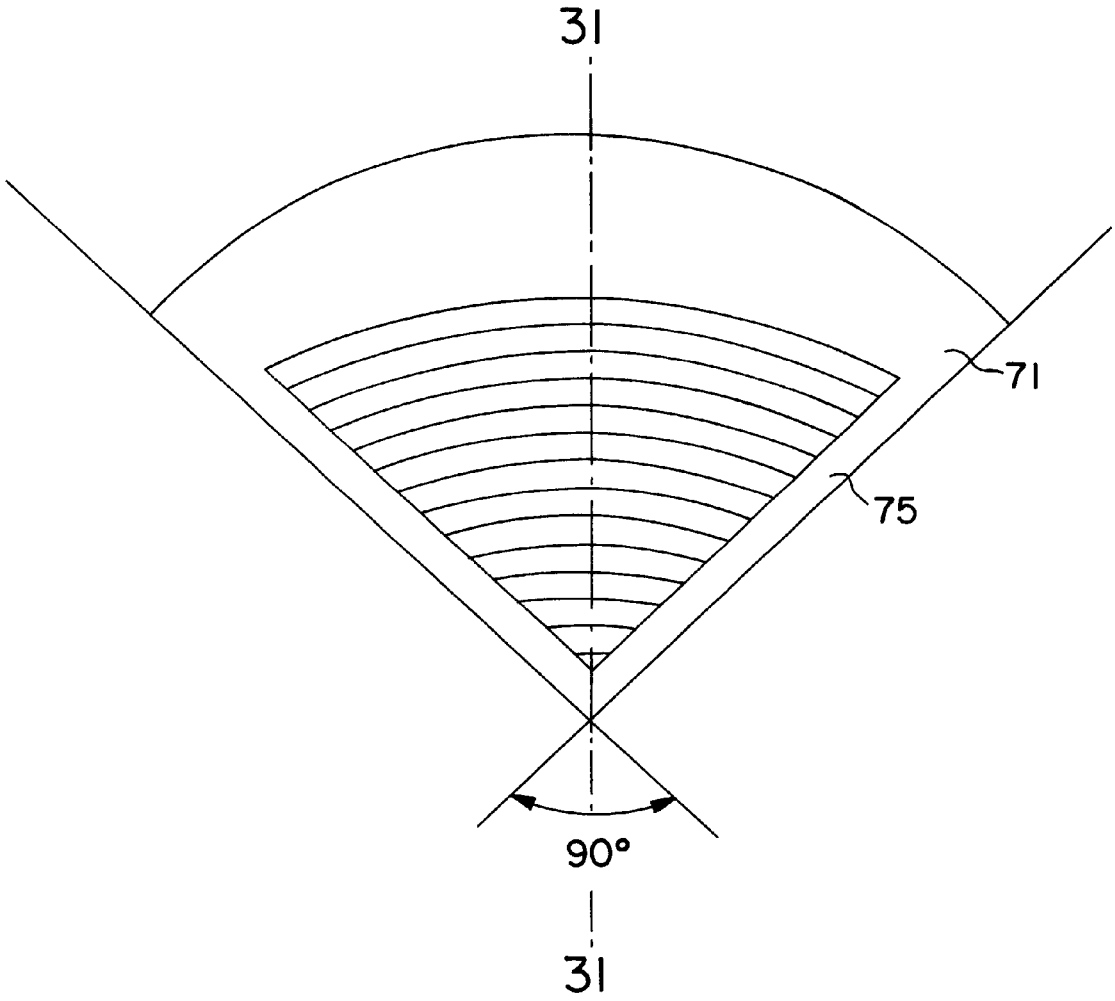
FIG. 30 PRIOR ART
FIG. 30 is a plan view of FIG. 29 as seen from the arrow direction.
Figure 31:
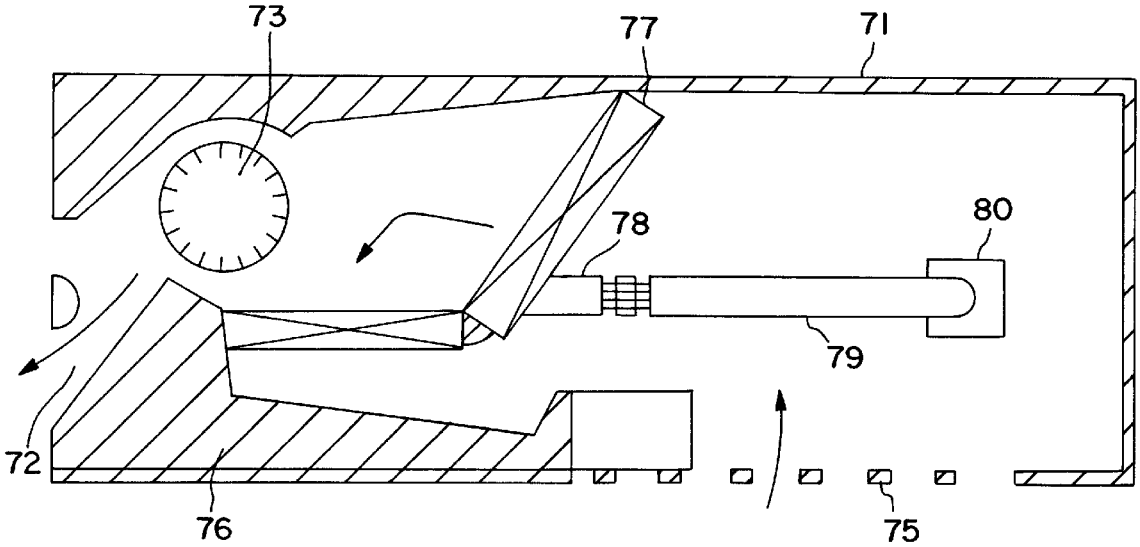
FIG. 31 PRIOR ART
FIG. 31 is a sectional view along line 31—31 of FIG. 30.
Figure 32:
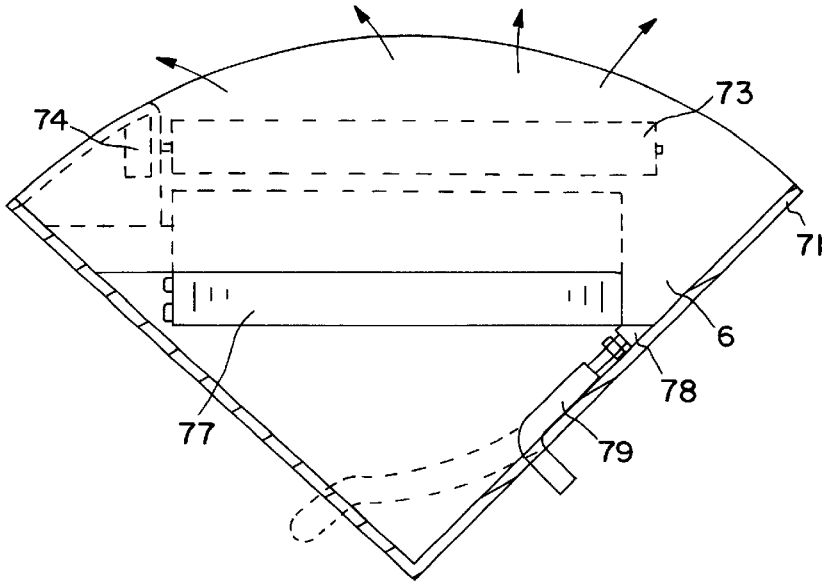
FIG. 32 PRIOR ART
FIG. 32 is a sectional view of FIG. 31 as seen from the lower direction.
Figure 33:
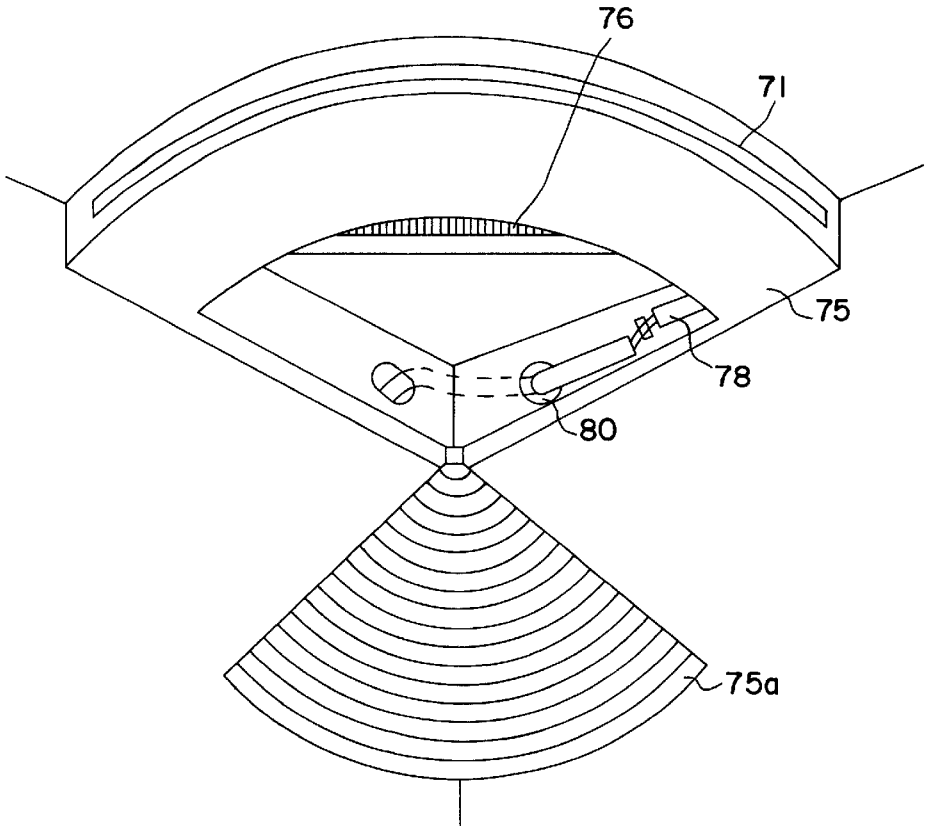
FIG. 33 PRIOR ART
FIG. 33 is a perspective view showing an open state of suction grille in FIG. 29.

Embodiment 15 of the invention is described below while referring to FIG. 27(*a*), FIG. 27(*b*), and FIG. 27(*c*). FIG. 27(*a*) is a perspective view of embodiment 15 of the invention, FIG. 27(*b*) is a plan view as seen from the direction of arrow 265, and FIG. 27(*c*) is a detail view of line 27(c)—27(c) when the air conditioner main body 201 is installed.

The space to be conditioned in the room is composed of a first wall 206, a second wall 205, and a ceiling 207. The air conditioner main body 201 is installed at a corner edge of the room by means of a first installation board 212, a second installation board 209, and a top installation board 226. The first installation board 212 has a plurality of screw holes 218*a*, and a stopping part 216*a* The second installation board 209 has a plurality of screw holes 218*b*, and a stopping part 216*b*. The top installation board 226 has a plurality of screw holes 218*c*, and a ceiling stopping part 229. The first installation board 212 is mounted on the first wall 206 by screws through the screw holes 218*a*. The second installation board 209 is mounted on the second wall 205 by screws through the screw holes 218*b*. The top installation board 226 is mounted on the ceiling 207 by screws through the screw holes 218*c*. The air conditioner main body 201 has a plurality of engaging parts 214 and ceiling engaging part 230. Of the plurality of engaging parts, one engaging part 214 is engaged with the stopping part 216*a* of the first installation board 212, and other engaging part 214 is engaged with the stopping part 216*b* of the second installation board 209, while the ceiling engaging part 230 is hooked on the ceiling stopping part 229. In this way, the air conditioner main body 201 is installed in the room.

According to this constitution, the air conditioner main body 201 is mounted on three planes, that is, the first wall, second wall and ceiling. Therefore, the strength of installation of the main body is extremely enhanced. This embodiment may be also realized in other constitution, in which the top installation board 226 is coupled to the first installation board 212 and second installation board 209 by means of screws, and the top installation board 226, first installation board 212 and second installation board 209 are integrated. In this constitution, if the ceiling 207 has a weak strength such as soft constitution, the air conditioner 201 can be installed stably at the corner edge of the room. Moreover, at least two boards of the first installation board 212, second installation board 209 and top installation board 226 may be formed integrally. In this case, too, the same effects as mentioned above are obtained.

As described herein, the following effects are brought about by the constitution of the air conditioner of the invention.

Since the corner of the main body is cut off, a working space necessary for installation of the main body is kept. Therefore, the connection piping and others from the outdoor unit can be installed easily.

The upper part of the corner side of the main body can be cut off easily. Accordingly, the connection piping from the outdoor unit can be drawn into the main body also from the ceiling side. As a result, the degree of freedom of installation method of the air conditioner is enhanced, and the installation work is much easier.

The connection work of the drain hose can be done by utilizing the space after installing the main body, so that the installation work of the air conditioner is extremely easy.

When installing the main body, it is not necessary to pass the connection piping or others from the outdoor unit as required in the prior art, and the working space is maintained, and the work is easier.

The connection piping from the outdoor unit can be drawn into the main body also from the ceiling side, and the degree of freedom of installation method is increased, and the working efficiency is improved.

The working space is further expanded, and the installation work of the air conditioner is much easier.

As the cover is provided, invasion of dust from upper direction is prevented, and as the package size for transportation as compared with the main body composed together with the cover integrally, the size can be reduced, and the transportation cost is reduced, and it is easier to carry.

As the cover placed on the upper part of the corner side can be cut off, the connection piping from the outdoor unit can be drawn into the main body also from the ceiling side, and the degree of freedom of installation method is enhanced, and hence the installation work is much easier.

The piping can be connected while the suction grille at the lower side is not installed yet, so that the working space is wider and the ease of work is further enhanced.

The corner side not capable of holding the suction grille by the main body can be held by the installation member, so that the holding strength of the suction grille is enhanced.

In this constitution, if the position is deviated between the main body and the installation member, the suction grille is positioned by the main body that requires positioning, and the vertical direction which requires the holding strength is held by the installation member, so that the strength for holding is further enhanced.

When installing the main body, it can be carried securely by holding the handle and the front air diffuser, so that the working efficiency is enhanced.

When installing the main body, it can be carried securely by holding the lower handles, so that the working efficiency is enhanced.

Thus, according to the constitution of the installation tool of the invention, the air conditioner main body can be installed on the plane of installation of two walls, and the installation is easy, and also the strength of installation of the air conditioner is excellent. Further, when mounting the first installation board and second installation board on the wall, it does not require level, angle gauge or other tool, and the air conditioner can be installed horizontally on the ceiling. It is also possible to installed at a specified position at the intersecting line of the first wall and second wall. Even if the crossing side of the adjacent mounting planes is protruding depending on the shape of the mounting position setting part, the air conditioner can be installed easily. The installation board can be placed along the plane of installation, corresponding to the angle of the corner edge of the room. Without losing one of the installation boards, mismatching of installation boards can be prevented. The installation boards can be manufactured by using one die only, and the cost is saved, and wrong combination of installation boards can be avoided. By forming the first installation board and second installation board integrally, the air conditioner can be installed easily regardless of the specified angle formed by the first installation board and second installation board. By using the first installation board, second installation board and top installation board, the strength of installation of the air conditioner main body is notably enhanced.

What is claimed is:

1. An air conditioner for installation at a corner of a first wall and a second wall of a room, comprising:

a main body having an upper part, a lower part, side parts, and a rear portion that faces said corner, a blower for circulating air, a heat exchanger for exchanging heat with said air, an electrical unit, an air diffuser for blowing out said air into the room, a piping connected to said air conditioner, and a piping connection of said piping disposed at a position extending into a space, wherein said space is defined by said rear portion, said first wall and said second wall.

2. An air conditioner of claim 1, wherein one of (a) said upper part and (b) an upward part of said side part and said side part extends into said space.

3. An air conditioner of claim 2, wherein said upper part has a slit for making a notch, and part of said upper part may be removed as being notched along said slit.

4. An air conditioner of claim 1, further comprising a connection port for connecting to a drain hose for discharging condensate of said heat exchange, wherein said connection port is disposed near said space, and near one wall of said first wall and said second wall.

5. An air conditioner of claim 1, wherein said electrical unit is positioned at least at one position of said space and a position near said space, said main body has a provisional holding part, and therefore, in the installation work, said electrical unit can temporarily escape from said position to said provisional holding part.

6. An air conditioner of claim 1, further comprising a cover separate from said main body so as to cover above said space.

7. An air conditioner for installation at a corner of a first wall and a second wall of a room, comprising:

a main body having an upper part, a lower part, and side parts, a blower for circulating air, a heat exchanger for exchanging heat with said air, an electrical unit, an air diffuser for blowing out said air into the room, a space positioned at an edge of said corner, and a piping connected to said air conditioner, a cover separate from said main body so as to cover above said space, wherein a piping port of said piping is disposed at a position extending into said space, said cover has a slit, and part of said cover can be removed as being notched along said slit.

8. An air conditioner for installation at a corner of a first wall and a second wall of a room, comprising:

a main body having an upper part, a lower part, and side parts, a blower for circulating air, a heat exchanger for exchanging heat with said air, an electrical unit, an air diffuser for blowing out said air into the room, a space positioned at an edge of said corner, and a piping connected to said air conditioner, a cover separate from said main body so as to cover above said space, wherein a piping port of said piping is disposed at a position extending into said space, and said cover is made of an easily cut material.

9. An air conditioner of claim 1, further comprising a suction grille which may be installed on said lower part of said main body, wherein said suction grille may be mounted on said main body after said main body is installed at said corner.

10. An air conditioner of claim 1, further comprising a suction grille which may be installed on said lower part of said main body, and a installation member for installing said main body in said room, wherein said suction grille is held by both said main body and said installation member.

11. An air conditioner of claim 10, wherein said installation member holds only in the vertical direction of said suction grille, and said main body positions in the vertical direction and horizontal direction of said suction grille.

12. An air conditioner of claim 1, wherein said main body has a handle at least at one position of (a) a surface contacting with said space, and (b) a position near said space.

13. An air conditioner for installation at a corner of a first wall and a second wall of a room, comprising:

a main body having an upper part, a lower part, and side parts, a blower for circulating air, a heat exchanger for exchanging heat with said air, an electrical unit, an air diffuser for blowing out said air into the room, a space positioned at an edge of said corner, and a piping, connected to said air conditioner, wherein a piping port of said piping is disposed at a position extending into said space, and said lower part of said main body has a handle.

14. A method of installing an air conditioner main body at a corner of a first wall and a second wall of a room, comprising the steps of:

(a) supplying an air conditioner main body, said main body comprising:

a frame body having an upper part, a lower part, side parts, and a rear portion that faces said corner, a blower for circulating air, a heat exchanger for exchanging heat with said air, an electrical unit, an air diffuser for blowing out said air into the room, a first piping connected to said air conditioner, and a piping connection of said first piping being disposed at a position extending into a space, said space being defined by said rear portion, said first wall and said second wall, (b) exposing a second connection piping linking to an outdoor unit, in said wall, (c) supplying an installation tool for installing said main body in said room, (d) fixing said installation tool to the wall of said room, (e) mounting said main body on said installation tool, and (f) connecting said piping port of said first piping to said second piping, in said space.

15. A method of claim 14, wherein one of (1) said upper part and (2) an upward part of said upper part and said side part extends into said space, and said step (f) is a step of connecting said connection port of said first piping from the lower part side of said main body to said second piping.

16. A method of claim 14, wherein said main body has a connection port for discharging condensate of said heat exchanger, said step (b) further has a step of exposing a drain hose linking outdoors from said wall, and said step (f) has also a step of connecting said connection port and said drain hose.

17. A method of claim 14, wherein said main body includes a cover separate from said main body so as to cover above said space, and said step (f) is a step of notching and removing part of said cover, and connecting said piping port of said first piping to said second piping through the removed part.

18. A method of installation for installing an air conditioner main body at a corner of a room, comprising the steps of:

(a) supplying said air conditioner main body having a first side surface and a second side surface and a rear surface, said air conditioner including a piping connection disposed at a position extending into a space, (b) fixing a first installation board having a first base part, a first stopping part and a first fixing part to a first wall of said room, and fixing a second installation board having a second base part, a second stopping part and a second fixing part to a second wall of said room, and (c) mounting said first side surface to said first stopping part, and mounting said second side plate to said second stopping part, wherein said space is defined by said rear surface, said first wall and said second wall.

19. A method of installation of claim 18, wherein said first side surface has a first engaging part, said second side surface has a second engaging part, and said step (c) is a step of engaging said first engaging part in said first stopping part, and engaging said second engaging part in said second stopping part.

20. A method of installation of claim 18, wherein said first installation board has a first mounting position setting part extending to the side part, said second installation board has a second mounting position setting part extending to the side part, and said step (b) is a step of fixing said first base part to said first wall while fitting said first mounting position setting part to said second wall, and fixing said second base part to said second wall while fitting said second mounting position setting part to said first wall.

21. A method of installation of claim 18, wherein said first installation board has a first horizontal setting part extending to the upper part, said second installation board has a second horizontal setting part extending to the upper part, and said step (b) is a step of fixing said first base part to said first wall while fitting said first horizontal setting part to a ceiling of said room, and fixing said second base part to said second wall while fitting said second horizontal setting part to said ceiling.

* * * * *